US007202005B2

(12) United States Patent
Tomoyori

(10) Patent No.: US 7,202,005 B2
(45) **Date of Patent: *Apr. 10, 2007**

(54) IMAGE FORMING METHOD AND AN IMAGE FORMING APPARATUS

(75) Inventor: Kageyuki Tomoyori, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 262 days.

This patent is subject to a terminal disclaimer.

(21) Appl. No.: 10/800,568

(22) Filed: Mar. 15, 2004

(65) Prior Publication Data

US 2005/0202333 A1 Sep. 15, 2005

(51) Int. Cl.
*G03G 5/00* (2006.01)

(52) U.S. Cl. ..... 430/120; 430/56; 430/69; 399/159

(58) Field of Classification Search ..... 430/120, 430/110.3, 110.4, 56, 69; 399/159
See application file for complete search history.

(56) References Cited

U.S. PATENT DOCUMENTS 5,953,562 A * 9/1999 Kawaguchi et al. ..... 399/117
6,780,558 B2 * 8/2004 Yamada et al. ..... 430/124
6,921,616 B2 * 7/2005 Yamazaki et al. ..... 430/45
2003/0190547 A1 * 10/2003 Kobayashi et al. ..... 430/125

* cited by examiner

*Primary Examiner*—John L Goodrow
(74) *Attorney, Agent, or Firm*—Lucas & Mercanti, LLP

(57) ABSTRACT

Disclosed is an image forming method comprising: developing a latent image formed on a cylindrical electrophotographic photoreceptor having a cylindricity of 5 to 40 μm, with a developer comprising a toner sufficing at least one of conditions (1) to (5):

(1) A toner includes toner particles having a variation coefficient of shape coefficient of not more than 16 percent.

(2) A toner includes at least 65 percent of toner particles having a shape coefficient in the range of 1.2 to 1.6.

(3) A toner includes at least 50% of toner particles in number having no corner.

(4) A toner includes toner particles having a number variation coefficient in the number particle size distribution of not more than 27 percent.

(5) A toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

38 Claims, 8 Drawing Sheets

FIG. 2
(a)
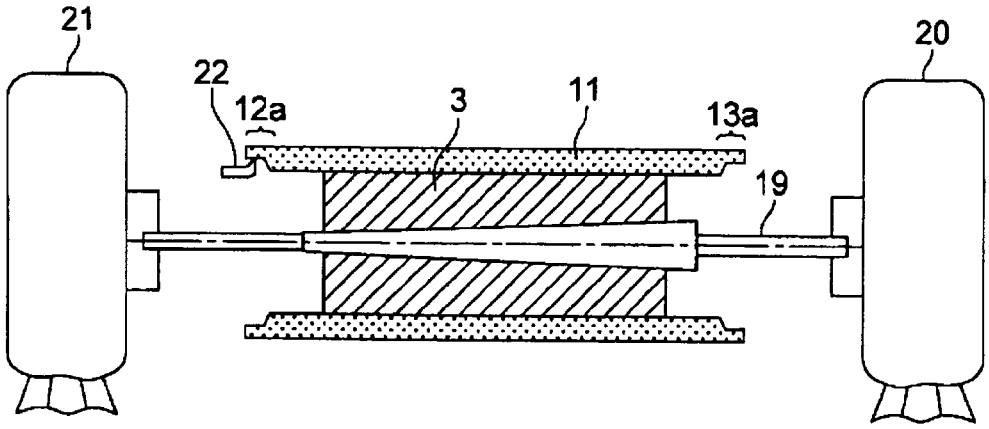
(b)
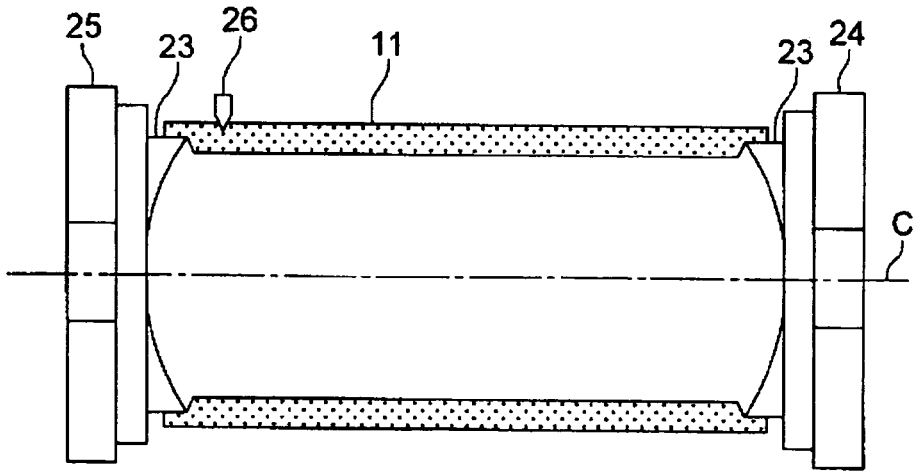

IMAGE FORMING METHOD AND AN IMAGE FORMING APPARATUS

TECHNICAL FIELD

The invention relates to an image forming method for use in an electrophotographic copying machine or printer.

RELATED ART

In recent years, as a result of the modern progress of digital image processing techniques, digital image formation has become a mainstream of image forming methods. In the digital image forming method, basically, images comprised of minute dots of, for example, 400 dpi (dots per inch; the number of dots per 2.54 cm) are developed. Thus, high image quality techniques capable of faithfully reproducing such minute dot images are needed. Especially, in recent years, demands for compactness, higher resolution and full color image formation of copying machines and for improved resolution of printers have increased. In case higher accuracy such as high resolution is needed, further improved image quality techniques are also demanded.

With a view toward realization of such high image quality, studies have been made on reduction of the particle diameter of toner while controlling the shape factors and the particle size distribution thereof. In particular, an attempt has been made to reduce the toner particle diameter while narrowing shape distribution and particle size distribution of the toner for the purpose of realizing improved resolution and precise reproduction of fine half tone images, thereby realizing an improved image quality. However, the intended high quality images are not obtainable in practice by using small diameter toner. Rather, some problems result from the use of small diameter toner. A problem in cleaning is one of them. Since the apparent adhesive force of such small toner onto a photoreceptor increases, it is difficult to clean the photoreceptor. In particular, since the toner obtained by emulsion polymerization method or suspension polymerization method effective to prepare small diameter toner has not only a small particle diameter but also a high particle roundness. Therefore, in the cleaning process for cleaning the photoreceptor with a cleaning blade, toner particles remaining on the photoreceptor have a tendency to pass through between the photoreceptor and the edge of the cleaning blade to cause cleaning failure.

In order to solve the above problems, it is important that processing units constituting an electrophotographic image forming apparatus should have high accuracy. Especially, it is required that the positional relationship between the surface of a photoreceptor and each of a developing section, a transfer section and a cleaner should be strictly maintained. Displacement from the original relationship of those positions is apt to causes the following image defects:

(1) A positional displacement between the photoreceptor and the exposing section causes a reduction of resolution due to a focal offset of a laser beam;

(2) A positional displacement between the photoreceptor and the developing section (Dsd) causes fogs, a reduction of the image density and a reduction of resolution;

(3) A positional displacement between the photoreceptor and the transfer section causes a reduction of the image quality such as thin spots and blurs of the transferred image; and (4) A positional displacement between the photoreceptor and the cleaning blade involves a variation of the blade pressure, causing a cleaning failure and reduction of durability of the photoreceptor.

As described above, it will be understood that the above positional displacement between the photoreceptor and the image forming members around the photoreceptor significantly adversely affects the image quality of the electrophotographic image and also one of the factors for defining such positional relationship is positional accuracy of the photoreceptor.

Under the circumstances above, the methods and/or image forming apparatus that is able to enhance high quality images is desired.

SUMMARY

In accordance with a first aspect of the present invention, the image forming method comprises:

developing a latent image formed on a cylindrical electrophotographic photoreceptor having a cylindricity of 5 to 40 μm, with a developer comprising toner satisfies at least one of following conditions (1) to (5):

(1) A toner includes toner particles having a variation coefficient of shape coefficient of not more than 16 percent;

(2) A toner includes at least 65 percent of toner particles having a shape coefficient in the range of 1.2 to 1.6;

(3) A toner includes at least 50% of toner particles in number having no corner;

(4) A toner includes toner particles having a number variation coefficient in the number particle size distribution of not more than 27 percent; and (5) A toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

BRIEF DESCRIPTION OF THE DRAWING

FIGS. 2A and 2B show the one embodiments of manufacturing processes of a cylindrical substrate in order;

FIGS. 7(*b*) and (*c*) are schematic views showing toner particle having corner;

FIG. 9 is a schematic cross section view showing a reaction vessel for the toner.

DETAILED DESCRIPTION OF THE EXEMPLARY EMBODIMENTS

Figure 1:
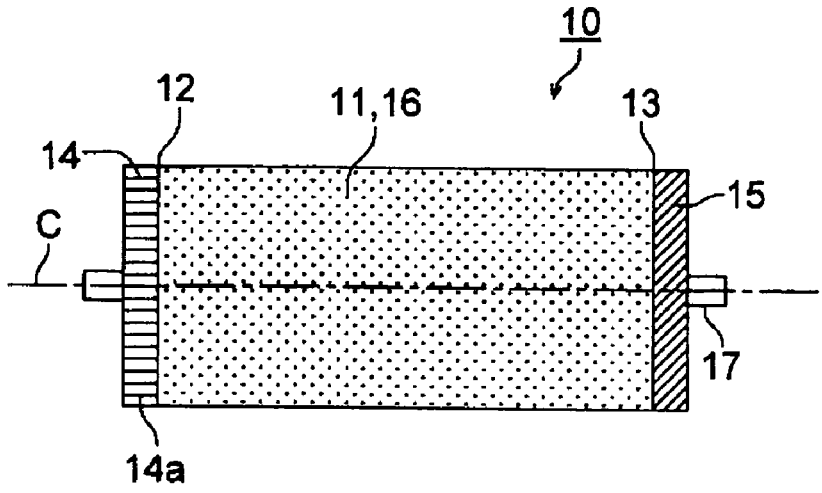
FIG. 1 is a schematically front view illustrating one example of a photoreceptor according to the invention.

Hereinafter, the invention is explained in accordance with exemplary embodiments. However, there is no intention to limit the invention only to those exemplary embodiments. The obvious changes and/or substitution are included in the invention.

The cylindricity represents a distance between a first geometrically correct cylinder inscribed coaxially therewith in a sample cylinder to be measured and a second geometrically correct cylinder circumscribed coaxially therewith about the sample cylinder such that the distance is minimum. The distance is measured in the radial direction of the sample cylinder.

That is, the term "cylindricity" is as defined in JIS B0621-1984 and represents a difference of radii between a geometrically correct cylinder inscribed in a cylindrical substrate coaxially therewith and a geometrically correct cylinder circumscribed about the cylindrical substrate coaxially therewith in case that the space between the two geometrically correct cylinders are minimum. The difference between radii is represented in the unit of μm.

In other words, the cylindricity is indicated as a difference between radii of a maximum circumscribed diameter and a maximum circumscribed diameter.

The cylindricity of the cylindrical electrophotographic photoreceptor (hereinafter referred as "electrophotographic photoreceptor" or "photoreceptor") should be 5 to 40 μm, narrowly 7 to 30 μm, and particularly 7 to 27 μm.

By employing the cylindricity of the photoreceptor in the above range, it can be prevented from the defects of (1) to (4) described above. In addition, the range is advantageous from the standpoint of costs in view of the yield of the photoreceptor. The cylindricity of the electrophotographic photoreceptor means the cylindricity of the portion which is substantially utilized for forming images. Thus, the portions adjacent to both edges of the electrophotographic photoreceptor in which an image formation is not performed and portion where the thickness of the photosensitive layer varies in the edges are not taken into account.

The cylindricity is determined by measuring the roundness at each of the seven positions including a midpoint, two positions spaced a distance of 10 mm from opposite ends, and four intermediate positions determined by dividing a distance between the midpoint and each end into 3 divisions, using a non-contact universal roll diameter measuring device (available from Mitsutoyo Co., Ltd.).

The term "in low process" as used herein means cutting the inside of the cylindrical substrate to form a machined surface such as a step (for the purpose of attaching a member). For example, while rotating the cylindrical substrate, a cutting bite is fed in the inside periphery of the cylindrical substrate and is fed in the axial direction to form a step.

In the invention, since the inlay process is mainly for the purpose of forming a step in each of the opposite end portions of the cylindrical substrate for fitting flanges in respective steps, steps having a length of d mm (the inlay length of the invention) in the axial direction of the cylindrical substrate are formed at both ends of the cylindrical substrate.

The axial length D(mm) of the supporting member is preferably within the following range:

$$\frac{1}{2}\times L < D < (L-2d)$$

wherein L is the length (mm) of the cylindrical substrate (axial direction). When the length D is smaller than ½×L, the both ends of the cylindrical substrate are apt to spin so that accuracy in machining cannot be achieved. When D is (L−2d) or more, a sufficient space for the inlay process is not feasible so that it becomes difficult to perform the inlay process.

The supporting member is intended to refer to a member inserted to press fit into the internal bore of the cylindrical substrate, thereby preventing the vibration and deformation of the cylindrical substrate while the cylindrical substrate is machined, such as the inlay process or the like.

The outside diameter reference means that the center axis of the outer cylindrical surface of the cylindrical substrate shall be the reference axis.

The inside diameter reference for the inlay processed portion means that the center axis of the inside cylindrical surface formed by the inlay process shall be the reference axis.

The invention will now be described in detail below with reference to the accompanying drawings.

FIG. 1 is a schematically front view, illustrating an electrophotographic photoreceptor 10, which comprises a cylindrical substrate 11 and flanges 14, 15 provided at opposite ends 12, 13, respectively, of the cylindrical substrate 11. A photosensitive layer 16 is formed over an outer peripheral surface of the cylindrical substrate 11. The electrophotographic photoreceptor 10 has a centerline along which a shaft 17 is disposed in conformity with the axis C of the cylindrical substrate 11 so that the photoreceptor 10 is rotatable about the axis C.

The cylindrical substrate 11 is made of a conductive metal such as aluminum or an aluminum alloy and defines a hollow cylindrical space therewithin. The cylindrical substrate 11 of, for example aluminum alloy may be formed into a cylindrical shape by a drawing or a cutting process.

The flanges 14, 15 which are in the form of discs are fitted into opposite end portions of the cylindrical substrate 11 and each provided with a bore 18 at the center thereof. One flange 14 has a geared periphery 14*a* for use in control of the rotation of the photoreceptor 10.

The bar like shaft 17 is preferably made of an undeformable material, such as, a metal or plastic, and has a rectangular (e.g. square), circular or cross-shaped cross section. The shaft 17 is passed through the bores 18 formed in the flanges 14, 15 and fixed for bearing the electrophotographic photoreceptor 10 for rotation.

The photosensitive layer 16 comprises a photoconductive material exhibiting a photoelectric effect and may be, for example, an organic photoconductive layer (OPC).

In order to produce the electrophotographic photoreceptor, it is necessary first to prepare the cylindrical substrate 11 having a cylindricity of 5 to 40 μm.

FIGS. 2A and 2B illustrates the manufacturing processes of a cylindrical substrate according to the invention in order. First, a cylindrical substrate 11 as shown in FIG. 2A is provided. The cylindrical substrate 11 may be, for example, an aluminum alloy cylinder having an outer diameter of 100 mm and a wall thickness of 2 mm which is formed by a drawing process.

FIG. 2A shows a process in which a supporting member 3 is inserted into the cylindrical substrate 11 and is being cutting with a bite for the inlay process. At each inside wall of the opposite end portions, a step is given by the inlay process, thereby forming thin wall portions (inlay processed portion) 12*a*, 13*a* having the same outside diameter as they were, while the thickness is made smaller by the thickness of the step, that is, the inside diameter becomes larger.

According to the invention, in the inlay process, while the cylindrical substrate 11 is supported from inside by the supporting member 3 and the pressure controlling section 4, the cylindrical substrate is rotated about the center shaft 19 which extends through the supporting member by the motors 20, 21. A cutting bite 22 is displaced while contacting with the inside of the cylindrical substrate, thereby performing the inlay process. Because the cylindrical substrate 11 is supported from inside during the inlay process, there is no fear of injures of the outer surface of the cylindrical substrate 11.

The cylindrical substrate 11 having the inlay process is then subjected to machining to cut the outer peripheral surface thereof. In FIG. 2A, the cylindrical substrate is held at inlay portions formed at both ands thereof by a pair of releasable holding pawls 23 of a non-sliding chucks 24, 25 (e.g. AIR BALLOON CHUCKS or KRAFTGRAPHY manufactured by Fujii Seimitsukogyo Co, Ltd; DIAPHRAGM CHUCKS manufactured by Dynamic Tool Co., Ltd.) and the peripheral outer surface of the cylindrical substrate 11 is machined with the inside diameter reference.

By adapting the above process method for the cylindrical substrate, the cylindrical substrate 11 for the electrophotographic photoreceptor having a cylindricity of 5 to 40 μm can be prepared. Reference numeral 26 denotes a cutting bite.

The supporting member is preferably made of a high strength and high rigidity material, such as a metal (e.g. stainless steel or brass) or a ceramic for reasons of prevention of vibration and deformation of the cylindrical substrate during the inlay process. It is also preferred that the supporting member be provided with sections for controlling the contact pressure. A method of inserting and pressing the rigid member against the inside surface of the cylindrical substrate will be described as follows:

FIG. 3A is a perspective view of the supporting member 3. FIG. 3B is a sectional view of the pressure variable section 4 of the supporting member. In this embodiment, the supporting member 3 is composed of sections 3-1 to 3-8 each of which has a sector-shaped cross-section and which are interconnected to each other by resilient members such as springs (not shown). The outside periphery of the supporting member 3 is cylindrical so as to contact the inside cylindrical periphery of the cylindrical substrate. At the central portion of the supporting member, as shown in FIG. 3B, there is formed a central bore for putting in and out a center rod 41 having a taper. As shown in FIG. 3B, insertion of the center rod 41 forces the supporting member to expand outwardly and thus the cylindrical substrate is held while it is pressed. The contact pressure upon pressing can be controlled depending on the axial displacement of the center rod 4-1.

Alternatively, the supporting member 3 may be formed of a resilient material such as a hard urethane resin or a rubber.

The center rod 4-1 has a center axis 19 passing through the supporting member, about which the cylindrical substrate is rotated for inlay process.

Figure 4:
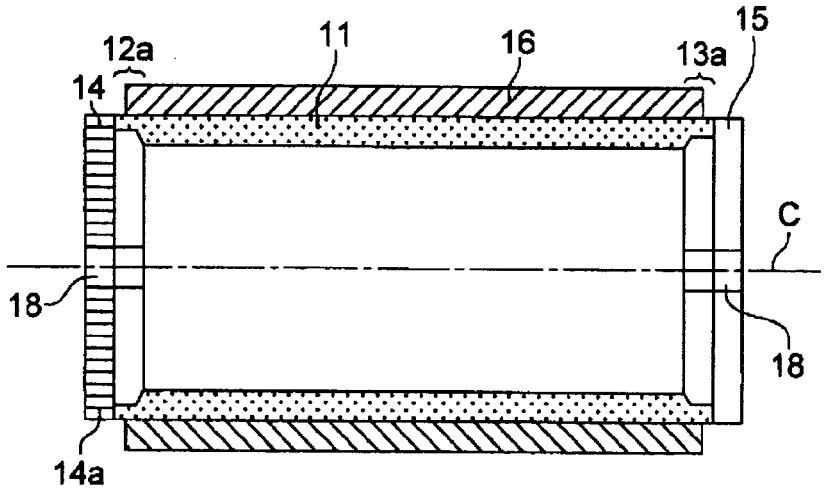
FIG. 4 is a sectional view of one example of a cylindrical substrate, an outer surface of which a photosensitive layer is applied.

The outer surface of the substrate 11 is then washed and applied with a photosensitive coating to form the photosensitive layer 16 as shown in FIG. 4.

Thereafter, the flanges 14, 15 are attached to the substrate 11 having a photosensitive layer coated. Each of the flanges 14, 15 is in the form of a disk having an outer section serving as a lid and having an outer diameter nearly equal to that of the cylindrical substrate 11, and an inner section having an outside diameter smaller than that of the outside section. At the center of the disk, a bore 28 is formed. The outside diameter of the inner section is equal to or slightly larger than the inside diameter of the thin wall portions 12*a* 13*a*. Thus, the flanges 14, 15 can be fixedly secured to the substrate 11 with the smaller diameter sections being tightly fitted into the thin wall portions 12*a*, 13*a*. The flanges 14, 15 are thus secured to the respective ends of the cylindrical substrate 11 in a lid like manner. The photoreceptor preferably has a cylindricity of 5 to 40 μm with a center of a shaft C of the cylindrical substrate 11, in the state of the flanges 14, 15 being attached. The flange 14 has a gear 14*a* on a periphery portion. There is formed a bore 18 for fixing the shaft at the central portion of each flange.

Description will be next made of the constitution of the electrophotographic photoreceptor.

It is preferable that the photoreceptor is an organic electrophotographic photoreceptor (also referred to as organic photoreceptor) from the standpoint of costs and environmental acceptability, although it can be applied to an inorganic photoreceptor using selenium or amorphous silicon. The organic photoreceptor as used herein is intended to refer to a photoreceptor using an organic compound given at least one of charge transport function and charge generation function which are indispensable for constituting an electrophotographic photoreceptor. The organic photoreceptor includes any customarily employed organic photoreceptor using an organic charge transport material or an organic charge generation material, or using a polymeric complex material having both charge transport and generation functions.

Although the layer structure of the organic photoreceptor is not limited, the photosensitive layer may be preferably a laminate of a charge generating layer and a charge transporting layer or a single layer having both charge transport and generation functions. A protecting layer may be preferably provided over the photosensitive layer.

Cylindrical Substrate

A drum of metal such as aluminum or nickel may be suitably used as the cylindrical substrate. The specific electric resistively of the cylindrical substrate is preferably not more than $10^3$ Ωcm at room temperature.

Interlayer

An interlayer having a barrier function may be interposed between the electrically conductive substrate and the photosensitive layer.

The interlayer (including an undercoat layer) may be also formed for the purpose of improving the adhesion between the electrically conductive substrate and the photosensitive layer or for minimizing charge injection from the substrate. Examples of the material of the interlayer include polyamide resins, vinyl chloride resins, vinyl acetate resins, and copolymer resins comprising at least two repeating units of these resins. Of these subbing resins, polyamide resins are preferable as the resins which are capable of minimizing an increase in residual potential accompanied under repeated use. Further, the thickness of the interlayer comprised of these resins is preferably between 0.01 and 0.5 μm.

It is particularly preferred that the interlayer be comprised of a hardenable metal resin obtainable by thermally hardening an organic metal compound such as a silane coupling agent or a titanium coupling agent. The thickness of the interlayer comprised of the hardenable metal resin is preferably between 0.1 and 2 μm.

Photosensitive Layer

In the structure of a photoreceptor, the photosensitive layer preferably has a layered structure including a charge generating layer (CGL) and a charge transporting layer (CTL), although a single structure photosensitive layer having both of the charge generation function and the charge transport function may be used. An increase of the remaining potential accompanied with repetition of the use can be inhibited and another electrophotographic property can be suitably controlled corresponding to its purpose due to the separation the functions of the photosensitive layer into the charge generation and the charge transport. In the photoreceptor to be negatively charged, it is preferable that the CGL be provided on a subbing layer and the CTL be further provided on the CGL. In the photoreceptor to be positively charged, the order of the CGL and CTL in the negatively charged photoreceptor may be reversed. The most preferable photosensitive layer structure is the structure of the photoreceptor to be negatively charged having the function separated structure.

The photosensitive layer of the function separated negatively charged photoreceptor will be described in detail below.

Charge Generation Layer

The charge generation layer contains one or more charge generation materials (CGM). Other materials such as a binder resin and additives may be contained if desired.

Any conventional CGM may be suitably used for the purpose of the invention. Examples of usable CGM include a phthalocyanine pigment, an azo pigment, a perylene pigment and an azulenium pigment. Among them, the CGM having a steric and potential structure capable of taking a stable intermolecular aggregated structure can strongly inhibit the increasing of the remaining potential accompanied with the repetition of use. Specifically, examples of such the CGM include a phthalocyanine pigment and a perylene pigment each having a specific crystal structure. For example, a titanylphthalocyanine having the maximum peak of Bragg angle 2θ of Cu—Kα ray at 27.2° and a benzimidazoleperylene having the maximum peak of Bragg angle 2θ of Cu—Kα ray at 12.4° as the CGM are almost not deteriorated by the repetition of use and the increasing of the remaining potential is small.

A known binder can be used in the charge generation layer as the dispersion medium of the CGM. Examples of the most preferable resin include a formal resin, butyral resin, a silicone resin, a silicon-modified butyral resin and a phenoxy resin. The charge generation material is preferably used in an amount of 20 to 600 parts by mass per 100 parts by mass of the binder resin. By the use of such a resin, an increase of the remaining potential accompanied with the repetition of use can be minimized. The thickness of the charge generation layer is preferably from 0.01 μm to 2 μm.

Charge Transport Layer

The charge transport layer contains a charge transport material (CTM) and a layer-formable binder resin in which the CTM is dispersed. An additive such as an antioxidant may be further contained if desired.

Any customarily employed CTM may be used for the purpose of the invention. For example, a triphenylamine derivative, a hydrazone compound, a styryl compound, a benzizine benzyl compound and a butadiene compound may be used as the CTM. These charge transport material are usually dissolved in a suitable binder resin to form a layer. Among them, the CTM capable of minimizing the increasing of the remaining potential accompanied with repetition of use is one having a high electron mobility, and the difference in the ionization potential between the CTM and the CGM to be used in combination with the CTM is preferably not more than 0.5 (eV), more preferably not more than 0.25 (eV).

The ionization potential of the CGM and CTM is measured by a surface analyzer AC-1 (manufactured by Riken Keiki Co., Ltd.).

Examples of the resin to be used for CTL include a polystyrene, an acryl resin, a methacryl resin, a vinyl chloride resin, a vinyl acetate resin, a poly(vinyl butyral) resin, an epoxy resin, a polyurethane resin, a phenol resin, a polyester resin, an alkyd resin, a polycarbonate resin, a silicone resin, a melamine resin, a copolymer containing two or more kinds of the repeating unit contained the foregoing resins, and a high molecular weight organic semiconductive material such as poly(N-vinylcarbazole) other than the foregoing insulating resins.

Above all, the polycarbonate resin is most preferable as the binder for CTL. The polycarbonate resin is most preferable since the resin simultaneously improves the dispersing ability of the CTM and the electrophotographic property. The ratio of the binder resin to the charge transport material is preferably from 10 to 200 parts by mass to 100 parts by mass of the binder resin, and the thickness of the charge transport layer is preferably from 10 to 40 μm.

A coating method such as an immersion coating, a spray coating and coating by a coating amount controlling circular coating means may be used for preparing the inventive photoreceptor. Especially, the coating by the coating amount controlling circular coating method is preferably used so as to inhibit dissolution of the under layer as small as possible and to attain uniform coating. Accordingly, an electrophotographic photoreceptor having a cylindrical substrate with the roundness maintained. The coating amount controlling circular coating means is described in JP-Tokukaisho-58-189061A.

It is preferable that the toner satisfies at least one of conditions of (1) to (5), more preferable that the toner meets all the conditions of (1) to (5). The conditions of (1) to (5) are as follows.

(1) A toner includes toner particles having a variation coefficient of shape coefficient of not more than 16 percent.

(2) A toner includes at least 65 percent of toner particles having a shape coefficient in the range of 1.2 to 1.6.

(3) A toner includes at least 50% of toner particles in number having no corner.

(4) A toner includes toner particles having a number variation coefficient in the number particle size distribution of not more than 27 percent.

(5) A toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

Each of the conditions (1) to (5) is explained.

The shape coefficient of the toner (also referred as shape coefficient of toner particles) is represented by the formula described below and shows the degree of roundness of toner particles.

$$\text{Shape coefficient}=((\text{Maximum diameter}/2)^2\times\pi)/\text{Projection area}$$

Wherein the maximum diameter denotes the width of a particle, which is the distance between parallel lines when a projected image of a toner particle on a screen is placed between said parallel lines and the distance between said parallel lines becomes maximum. Further, the projection area denotes the area of the projected image of a toner particle on a screen.

Said shape coefficient is measured as follows. Toner particles are magnified to a factor of 2000 employing a scanning electron microscope and a photograph of said magnified toner particles is taken. The resulting photographic images are analyzed employing a Scanning Image Analyzer (manufactured by Nippon Denshi Co.). One hundred toner particles are measured and the shape coefficient of toner is calculated according to the above-mentioned formula.

The ratio of toner particles which have said shape coefficient in the range of 1.2 to 1.6 is preferably at least 65 percent by number, and is more preferably at least 70 percent by number.

Since an electrostatic latent image formed on a cylindrical electrophotographic photoreceptor having a cylindricity of 5 to 40 μm is developed with a developer containing the above toner, the resolution and cleaning efficiency can be improved so that clear and sharp electrophotographic images free of unevenness of halftone image portions can be obtained.

A cleaning failure is apt to be caused with a photoreceptor having a high cylindricity. This results in a reduction of resolution and unevenness of halftone images. However, when the latent image formed on the photoreceptor is developed with a developer containing such toner, clear, sharp images free of the above defects may be obtained.

Methods to control said shape coefficient are not particularly limited. One method is in which a toner having a shape coefficient of 1.2 to 1.6 is prepared, employing any of several methods in which, for example, toner particles are sprayed into a heated air flow; toner particles are repeatedly subjected to application of mechanical energy in a gas phase employing an impact force; toner is added to a solvent which does not dissolve the toner and is subjected to application of circulation flow; and the like, is added to ordinary toner and the resulting mixture is prepared so as to be in the range specified by the present invention. Furthermore, another method is one in which during the preparation of a so-called polymerization method toner, all shapes are controlled, and the toner, which is controlled so as to have a shape coefficient of 1.2 to 1.6, is added to an ordinary toner in the same manner as above to prepare a toner.

Of the above-mentioned methods, to prepare a toner, the polymerization method is preferred, due to the fact that it is simple and easy as a production method, the surface uniformity is excellent, compared to a pulverized toner, and the like.

The number variation coefficient in the number particle size distribution of toner is calculated by the formula described below:

The variation coefficient of the shape coefficient of the toner of the present invention is calculated by the formula below:

$$\text{Variation coefficient}=(S/K)\times 100 \text{ (in percent)}$$

wherein S denotes the standard deviation of the shape coefficient of 100 toner particles, and K denotes the average of the shape coefficient.

Said variation coefficient of the shape coefficient is generally not more than 16 percent, and is preferably not more than 14 percent.

Since an electrostatic latent image formed on a cylindrical electrophotographic photoreceptor having a cylindricity of 5 to 40 μm is developed with a developer containing the above toner, the resolution and cleaning efficiency can be improved so that clear and sharp electrophotographic images free of unevenness of halftone image portions can be obtained.

A cleaning failure is apt to be caused with a photoreceptor having a high cylindricity. This results in a reduction of resolution and unevenness of halftone images. However, when the latent image formed on the photoreceptor is developed with a developer containing such toner, clear, sharp images free of the above defects may be obtained.

In order to uniformly control said toner shape coefficient as well as the variation coefficient of said toner shape coefficient so as to minimize lot fluctuations, during the process in which resin particles are subjected to polymerization, fusing, and shape controlling, the process may be appropriately terminated while monitoring properties of toner particles (tinted particles) which are being formed.

Monitoring as described herein means that process conditions are controlled based on measurements obtained by measurement devices incorporated into the production line. For example, when a toner is prepared employing the polymerization method in which resin particles are associated or fused in an aqueous medium, during the fusing process and the like, sampling is successively carried out to measure the shape as well as particle diameter, and when the targeted shape is obtained, the reaction is terminated.

The monitoring methods are not particularly limited, and a flow type particle image analyzer FPIA-2000 (manufactured by To a Iyo Denshi Co.) may be used. Said device is suitably employed because shapes can be monitored in real-time from a flowing sample liquid. Namely, the particle shape and the like in a sample which is fed to said device from the reaction vessel, employing a pump, is continually monitored, and when the desired shapes are obtained, the reaction is terminated.

The number variation coefficient in the number particle size distribution of toner (also referred as the number variation coefficient in the number particle size distribution of toner particles).

The number particle size distribution as well as the number variation coefficient of the toner of the present invention is measured by either a Coulter Counter TA- or a Coulter Multisizer (both are manufactured by Coulter Co.). In the present invention, the Coulter Multisizer was used, which was connected to a particle size distribution output interface (manufactured by Nikkaki), via a personal computer. An aperture employed in said Coulter Multisizer was 100 μm, and the volume as well as the number of toner particles with at least 2 μm was measured to calculate the particle size distribution as well as the average particle diameter. The number particle size distribution as described herein represents the relative frequency of toner particles with respect to the toner diameter, and the number average particle diameter represents the median diameter in the number particle size distribution.

$$\text{Number variation coefficient}=(S/Dn)\times 100 \text{ (in percent)}$$

wherein S represents the standard deviation in the number particle size distribution, and Dn represents the number average particle diameter (in μm).

The number variation coefficient of the toner of the present invention should be generally not more than 27 percent, and preferably not more than 25 percent.

Since an electrostatic latent image formed on a cylindrical electrophotographic photoreceptor having a cylindricity of 5 to 40 μm is developed with a developer containing the above toner, the resolution and cleaning efficiency can be improved so that clear and sharp electrophotographic images free of unevenness of halftone image portions can be obtained.

A cleaning failure is apt to be caused with a photoreceptor having a high cylindricity. This results in a reduction of resolution and unevenness of halftone images. However, when the latent image formed on the photoreceptor is developed with a developer containing such toner, clear, sharp images free of the above defects may be obtained.

Methods to control the number variation coefficient of the present invention are not particularly limited. For example, a method may be employed in which toner particles are classified employing forced airflow. However, in order to decrease the number variation coefficient, classification in liquid is more effective. Classifying methods in liquid include one in which a toner is prepared by classifying and collecting toner particles in response to the difference in sedimentation rate generated by the difference in particle diameter while controlling rotational frequency, employing a centrifuge.

Specifically, when a toner is produced employing the suspension polymerization method, a classifying operation is essential in order to maintain the number variation coefficient in the number particle size distribution at not more than 27 percent. In said suspension polymerization method, it is required to disperse polymerizable monomers into an aqueous medium so as to form oil droplets having the desired size of the toner. Namely, large oil droplets comprised of the polymerizable monomers are subjected to repeated mechanical shear employing a homogenizing mixer or a homogenizer so as to decrease the size to be approximately equal to toner particles. However, when such mechanical shearing method is employed, the number particle size distribution broadens. As a result, when the resulting particles are employed for the preparation of a toner, the particle size distribution of the resulting toner also broadens. Due to this, a classifying operation becomes essential.

In the toner of the present invention, the ratio of toner particles having no corners is at least 50 percent by number, and is preferably at least 70 percent by number.

Since an electrostatic latent image formed on a cylindrical electrophotographic photoreceptor having a cylindricity of 5 to 40 μm is developed with a developer containing the above toner, the resolution and cleaning efficiency can be improved so that clear and sharp electrophotographic images free of unevenness of halftone image portions can be obtained.

A cleaning failure is apt to be caused with a photoreceptor having a high cylindricity. This results in a reduction of resolution and unevenness of halftone images. However, when the latent image formed on the photoreceptor is developed with a developer containing such toner, clear, sharp images free of the above defects may be obtained.

Figure 7:
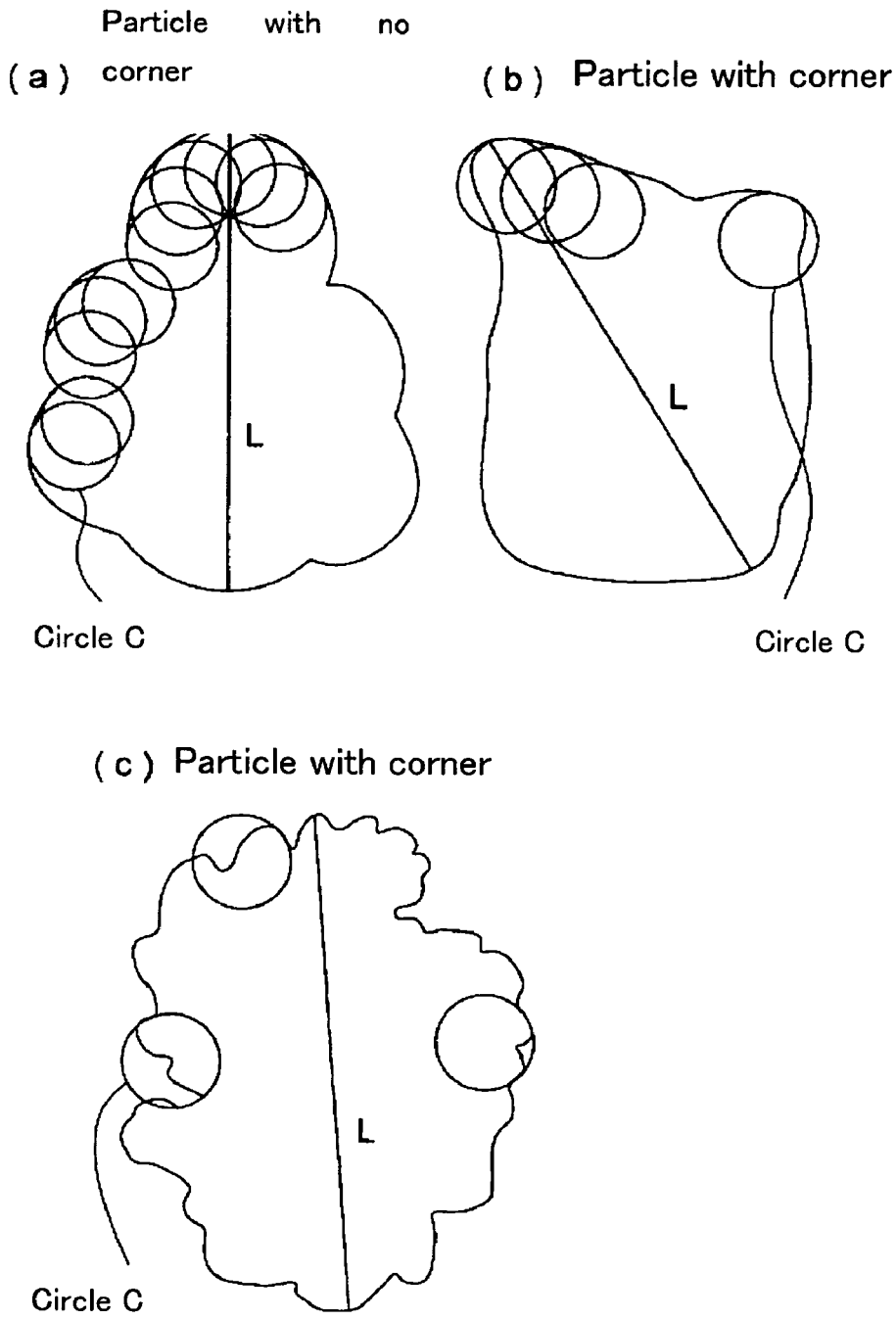
FIG. 7(*a*) is a schematic view showing toner particle having no corner.

Toner particles having no corners, as described in the present invention, represent those which have substantially neither projected portions at which electric charges can concentrate nor which are readily abraded due to stress. Specifically, the toner particle described below is denoted as a toner having no corners. Namely, as shown in FIG. 7(*a*), when a circle having a radius of L/10, wherein L represents the longer diameter of a toner particle, is rolled within the circumferential edge of the toner particle while being in internal contact with the edge at one point, and when said circle does not substantially cross over the edge, said toner particle is denoted as a toner having no corners.

"When said toner does not substantially cross over the edge" means that there is not more than one of the projected portions at which said circle crosses over the edge. The longer diameter of the toner particle as described herein means the maximum distance of the particle when the projected image of the particle on a screen is placed between two parallel lines. FIG. 7(*b*) and FIG. 7(*c*) show the toner particles having corners.

Said toner having no corners was measured as follows. First, a toner particle was magnified employing a scanning electron microscope and a photograph of said magnified particle was taken. The resulting photograph was further magnified to a magnification of 15,000 and a photographic image was obtained. Subsequently, employing the resulting photographic image, the presence of the above-mentioned corners was measured. Such measurement was carried out for 100 individual toner particles.

Methods to prepare toner having no corners are not particularly limited. For example, as described above, as methods to control the shape coefficient, the toner having no corners may be prepared employing methods in which toner particles are sprayed into a heated air flow; in a gas phase, toner particles are subjected to application of repeated mechanical energy by impact force; or a toner is added to a solvent which does not dissolve the toner and is subjected to application of a circulating flow.

Furthermore, in a toner prepared employing the polymerization method in which the toner is prepared by associating or fusing resin particles, at the fusing terminating stage, the surface of a fused particle is highly rough and is not at all smooth. Toner having no corners is prepared by suitably controlling conditions such as the temperature, the rotational frequency of stirring blades, the stirring time, and the like, during the shape controlling process. These conditions may vary depending on the physical properties of resin particles. For example, the surface of toner smoothens by increasing the rotational frequency at a temperature higher than the glass transition point of said resin particles, and subsequently, a toner having no corners can be obtained.

The particle diameter of the toner of the present invention is preferably 3 to 8 μm in terms of number average particle diameter. When toner articles are prepared employing the polymerization method, the resulting particle diameter may be controlled based on the concentration of a coagulant, the addition amount of organic solvents, the fusing time, and further, the composition of the polymer itself.

By controlling the number average particle diameter between 3 to 8 μm, transfer efficiency can be improved to obtain good halftone image quality, and also fine line and dot image quality can be improved.

The toner of the present invention preferably has a sum M of at least 70 percent. Said sum M is obtained by adding relative frequency m1 of toner particles, included in the most frequent class, to relative frequency m2 of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and the number of particles is used as an ordinate.

Since an electrostatic latent image formed on a cylindrical electrophotographic photoreceptor having a cylindricity of 5 to 40 μm is developed with a developer containing the above toner, the resolution and cleaning efficiency can be improved so that clear and sharp electrophotographic images free of unevenness of halftone image portions can be obtained.

A cleaning failure is apt to be caused with a photoreceptor having a high cylindricity. This results in a reduction of resolution and unevenness of halftone images. However, when the latent image formed on the photoreceptor is developed with a developer containing such toner, selection development can be prevented and then clear, sharp images free of the above defects may be obtained.

In the present invention, the above-mentioned histogram showing the particle size distribution based on the number of particles is one in which natural logarithm lnD (wherein D represents the diameter of each particle) is divided at intervals of 0.23 into a plurality of classes (0 to 0.23, 0.23 to 0.46, 0.46 to 0.69, 0.69 to 0.92, 0.92 to 1.15, 1.15 to 1.38, 1.38 to 1.61, 1.61 to 1.84, 1,84 to 2.07, 2.07 to 2.30, 2.30 to 2.53, 2.53 to 2.76 . . . ), being based on the number of particles. Said histogram was prepared in such a manner that particle diameter data of a sample measured by a Coulter Multisizer according to conditions described below were transmitted to a computer via an I/O unit, so that in said computer, said histogram was prepared employing a particle size distribution analyzing program.

(Measurement Conditions)

Aperture: 100 μm

Sample preparation method: added to 50 to 100 ml of an electrolytic solution (ISOTON R-11, manufactured by Coulter Scientific Japan Co) is a suitable amount of a surface active agent (a neutral detergent) and stirred. Added to the resulting mixture is 10 to 20 mg of a sample to be measured. To prepare the sample, the resulting mixture is subjected to dispersion treatment for one minute employing an ultrasonic homogenizer.

It is preferable that the toner is prepared by a method containing a step of polymerizing at least monomers in an aqueous medium. It is also preferable to use a coalesced type toner which is prepared by salting out and fusing resinous particles in an aqueous medium.

The toner according to the present invention may be prepared employing a method in which fine polymerization particles are prepared employing a suspension polymerization method, or a method in which monomers undergo emulsion polymerization in a solution to which an emulsified composition of necessary additives is added, and thereafter, association is carried out by adding organic solvents, coagulants, and the like. During said association, listed are methods in which preparation is carried out in such a manner that a dispersion of releasing agents, colorants, and the like, which are required to constitute a toner, is mixed and association is carried out, emulsion polymerization is carried out upon dispersing toner components such as releasing agents, colorants, and the like into monomers, and the like. Said association as described herein denotes that a plurality of resin particles and colorant particles are allowed to fusing with each other.

Namely, various constitution materials such as colorants, and if desired, releasing agents, charge control agents, further polymerization initiators, and the like are incorporated into polymerizable monomers, and each of the constitution materials is dissolved in or dispersed into the polymerizable monomers employing a homogenizer, a sand mill, a sand grinder, an ultrasonic homogenizer, and the like. The polymerizable monomers, into which these various constitution materials are dissolved or dispersed, are dispersed into an aqueous medium comprising a dispersion stabilizer so as to form oil droplets having a desired size. Thereafter, the resulting dispersion is transferred to a reaction apparatus having a stirring mechanism composed of stirring blades described below, and undergoes polymerization reaction upon raising its temperature. After completing the reaction, the dispersion stabilizer is removed, filtered, washed, and further dried to prepare the toner of the present invention.

Further, the aqueous medium as described in the present invention denotes one, which comprises water in an amount of at least 50 percent by weight.

Furthermore, also listed as a method to produce the toner of the present invention may be a method in which resin particles are prepared upon associating or fusing with each other in an aqueous medium. This method is not particularly limited, and other methods may be listed which are disclosed in, for example, Japanese Patent Publication Open to Public Inspection Nos. 5-265252, 6-329947, and 9-15904. Namely, the toner of the present invention is prepared employing a method in which a plurality of dispersion particles of the constitution materials comprised of resin particles, colorants and the like, or of fine particles comprised of resins, colorants, and the like, are associated, in which in particular, after dispersing these into water employing an emulsifier, the resulting dispersion is salted out by adding a coagulant in an amount of more than the critical coagulation concentration; at the same time, while forming fused particles upon heating the formed polymer at least to the glass transition temperature of the polymer, so as to fuse with each other, the particle diameter is increased; when growing the particle diameter to a desired diameter, a large amount of water is added to halt the growth of the diameter; the particle surface is then smoothed through heating and stirring, whereby the shape is controlled; and the resulting particles are heat dried in a fluid state while suspended in a water comprising state. Further, herein, organic solvents which are infinitely soluble in water may be added at the same time, together with a coagulating agent.

Employed polymerizable monomers to constitute a resin include styrenes or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate, and the like; acrylic acid ester derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; acrylic acid or methacrylic acid derivatives such as acrylonitrile, methacrylonitrile, acrylamide and the like. These vinyl based monomers may be employed individually or in combination.

Furthermore, still more preferably employed as polymerizable monomers, which constitute a resin, are those having an ionic dissociation group in combination, which are, for example, have a substituent such as a carboxyl group, a sulfonic acid group, a phosphoric acid group, and the like as a group constituting the substituent. Listed as specific examples are acrylic acid, methacrylic acid, maleic acid, itaconic acid, cinnamic acid, fumaric acid, monoalkyl maleate, monoalkyl itaconate, styrenesulfonic acid, allylsulfosuccinic acid, 2-acrylamide-2-methylpropanesulfonic acid, acidphosoxyethyl methacrylate, 3-chloro-2-acidphophoxypropyl methacrylate, and the like.

Further, the resin may be modified so as to have a cross-linking structure, employing multifunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, and the like.

These polymerizable monomers may undergo polymerization employing a radical polymerization initiator. In such cases, oil-soluble polymerization initiators may be employed in a suspension polymerization method. Such oil-soluble polymerization initiators include azo based or diazo based polymerization initiators such as 2,2'-azobis-(2,4-dimethylvaleronitrile, 2,2'-azobisisobutyronitrile, 1,1'-azobis(cyclohexane-1-carbonitrile), 2,2-azobis-4-methoxy-2,4-dimethylvaleronitrile, azobisisobutyronitrile, and the like; and peroxide based polymerization initiators and polymer initiators having a peroxide in the side chain such as benzoyl peroxide, methyl ethyl ketone peroxide, disopropylperoxycarbonate, cumenehydroperoxide, t-butylhydroperoxide, di-t-butylperoxide, dicumylperoxide, 2,4-dichlorobenzoyloxide, lauroylperoxide, 2,2-bis-(4,4-t-butylperoxycyclohexyl)propane, tris-(t-butylperoxy) triazine, and the like.

Further, when the emulsion polymerization method is employed, water-soluble radical polymerization initiators may be employed. Water-soluble polymerization initiators include persulfates such as potassium persulfate, ammonium persulfate, and the like, azobisaminodipropane acetic acid salts, azobiscyanovaleric acid and salts thereof, hydrogen peroxide, and the like.

Listed as dispersion stabilizers may be tricalcium phosphate, magnesium phosphate, zinc phosphate, aluminum phosphate, calcium carbonate, magnesium sulfate, calcium hydroxide, magnesium hydroxide, aluminum hydroxide, calcium metasilicate, calcium sulfate, barium sulfate, bentonite, silica, alumina, and the like. Further, also employed as dispersion stabilizers may be those which are generally employed as surface active agents such as polyvinyl alcohol, gelatin, methyl cellulose, sodium dodecybenzenesulfonate, ethylene oxide additives, higher alcohol sodium sulfate, and the like.

Preferred as excellent resins in the present invention are those having a glass transition point of 20 to 90 degree C., as well as a softening point of 80 to 220 degree C. The glass transition point is a value measured by a differential calorimetric method, while the softening point can be measured by an elevated type flow tester. Further, these resins preferably have a number average molecular weight (Mn) of 1,000 to 100,000, as well as a weight average molecular weight (Mw) of 2,000 to 1,000,000, which are measured by gel permeation chromatography. Further, as a molecular weight distribution, the Mw/Mn is preferably between 1.5 and 100, and is most preferably between 1.8 and 70.

The employed coagulating agents are not particularly limited, however those selected from metal salts are more suitable. Specific examples include salts of univalent metals such as alkali metals, for example, sodium, potassium, lithium and the like; alkali earth metal salts of divalent metals such as calcium, magnesium, and the like; salts of divalent metals such as manganese, copper, and the like; and salts of trivalent metals such as iron, aluminum, and the like. Listed as specific salts can be sodium chloride, potassium chloride, lithium chloride, calcium chloride, zinc chloride, copper sulfate, magnesium sulfate, manganese sulfate, and the like. These may be employed in combination.

These coagulants are preferably added in an amount exceeding the critical coagulation concentration. The critical coagulation concentration as described herein is an index on the stability of an aqueous dispersion, and concentration at which coagulation is formed by the addition of a coagulant. The critical coagulation concentration varies greatly depending on the emulsified components and dispersing agents themselves. For example, the critical coagulation concentration is described in Seizo Okamoto, et al. "Kobunshi Kagaku (Polymer Chemistry)", edited by Nihon Kobunshi Gakkai, whereby detailed critical coagulation concentration data can be obtained. Furthermore, as another method, zeta (zeta) potentials of a specified particle dispersion are measured upon adding a desired salt to the particle dispersion, while changing the salt concentration, and said salt concentration which varies the zeta potential can be obtained as the critical coagulation concentration.

The added amount of the coagulant of the present invention is acceptable if it exceeds the critical coagulation concentration. However, the addition amount is preferably at least 1.2 times of the critical coagulation concentration, and is more preferably at least 1.5 times.

A solvent which is infinitely soluble denotes a solvent which is infinitely soluble in water and as such solvents, those which do not dissolve the resin formed in the present invention are selected. Specifically, cited are alcohols such as methanol, ethanol, propanol, isopropanol, t-butanol, methoxyethanol, butoxyethanol, and the like, nitrites such as acetonitrile, and ethers such as dioxane. In particular, ethanol, propanol and isopropanol are preferred.

The added amount of such solvents which are infinitely soluble is preferably between 1 and 100 percent by volume of the polymer containing dispersion to which the coagulant is added.

Further, in order to make all particles of a uniform shape, after preparing colored particles and filtering them, the resulting slurry, in which water is present in an amount of at least 10 percent by weight of the particles, is preferably subjected to fluidized drying. At the time, those which comprise a polar group in the polymer are particularly preferred. As the reason, it is assumed that since existing water somewhat exhibits swelling effect for the polymer comprising the polar group, making particles of a uniform shape tends to be particularly easily carried out.

The toner of the present invention comprises at least a resin and a colorant, but may as well comprise a releasing agent which works as a fixing property improving agent, a charge control agent, and the like. Further, external additives comprised of fine inorganic particles, fine organic particles, and the like may be added to toner particles which are mainly comprised of the above-mentioned resin and colorant.

Optionally employed as colorants, which are employed in the toner of the present invention, may be carbon blacks, magnetic materials, dyes, pigments, and the like. Employed as said carbon blacks are channel black, furnace black, acetylene black, thermal black, lamp black, and the like. Employed as magnetic materials may be ferromagnetic metals such as iron, nickel, cobalt, and the like, as well as alloys which do not comprise ferromagnetic metals and are subjected to thermal treatment to exhibit ferromagnetism, such types of alloys being called Heusler alloys, being for example, manganese-copper-aluminum, manganese-copper-tin and the like, and also chromium dioxide, and the like.

Employed as dyes can be C.I. Solvent Red 1, Solvent Red 49, Solvent Red 52, Solvent Red 63, Solvent Red 111, and Solvent Red 122, C.I. Solvent Yellow 19, Solvent Yellow 44, Solvent Yellow 77, Solvent Yellow 79, Solvent Yellow 81, Solvent Yellow 82, Solvent Yellow 93, Solvent Yellow 98, Solvent Yellow 103, Solvent Yellow 104, Solvent Yellow 112, and Solvent Yellow 162; C.I. Solvent Blue 25, Solvent Blue 36, Solvent Blue 60, Solvent Blue 70, Solvent Blue 93, and Solvent Blue 95, and the like. Furthermore, these mixtures may be employed. Employed as pigments may be C.I. Pigment Red 5, Pigment Red 48:1, Pigment Red 53:1, Pigment Red 57:1, Pigment Red 122, Pigment Red 139, Pigment Red 144, Pigment Red 149, Pigment Red 166, Pigment Red 177, Pigment Red 178, and Pigment Red 222; C.I. Pigment Orange 31, and Pigment Orange 43; C.I. Pigment Yellow 14, Pigment Yellow 17, Pigment Yellow 93, Pigment Yellow 94, and Pigment Yellow 138; and C.I. Pigment Green 7; and C.I. Pigment Blue 15:3, and Pigment Blue 60; and the like. These mixtures may also be employed. The average primary particle diameter varies depending on type, generally, however it is preferably between about 10 and about 200 nm.

The colorants may be added employing ant of several common methods, in which colorants are added during which polymer particles prepared by an emulsion polymerization method are coagulated by adding a coagulant and the polymer is tinted; during polymerizing of said monomers, a colorant is added and the resulting mixture is polymerized to form tinted particles; and the like. Further, when the colorant is added during polymer preparation, it is preferably subjected to surface treatment employing a coupling agent and the like, which is employed so that radical polymerization is not hindered.

Further, added as fixing property enhancing agents may be low molecular weight polypropylene (having a number average molecular weight of 1,500 to 9,000) or low molecular weight polyethylene.

Charge control agents may also be employed, which are known in the art, and can be dispersed into water. Specifically listed are Nigrosine based dyes, metal salts of naphthenic acid or higher fatty acids, alkoxylated amines, quartenary ammonium salts, azo based metal complexes, salicylic acid metal salts or metal complexes thereof, and such.

Further, these charge control agents and fixing property enhancing agents are preferably in a dispersed state, and the number average primary particle diameter is adjusted from about 10 to about 500 nm.

Furthermore, the toner may be advantageously employed when combined with external additives of fine particles, such as fine inorganic particles and fine organic particles. As the reason for such combining, it is assumed that burying and releasing of external additives may be effectively minimized, and its effect is markedly exhibited.

Preferably employed as such fine inorganic particles are inorganic oxide particles such as silica, titania, alumina, and the like. These fine inorganic particles are preferably subjected to hydrophobic treatment employing silan coupling agents, titanium coupling agents, and the like. The degree of the hydrophobic treatment is not particularly limited, however the degree is preferably between 40 and 95 measured as methanol wettability. The methanol wettability as described herein means the evaluation of wettability for methanol. In this method, 0.2 g of fine inorganic particles is weighed and added to 50 ml of distilled water placed in a 200 ml beaker. Methanol is slowly added dropwise while slowly stirring from a burette of which top is immersed in the solution until entire fine organic particles are wet. The degree of hydrophobicity is calculated from the formula given below:

$$\text{Degree of hydrophobicity}=a/(a+50)\times 100$$

wherein "a" (in m1) represents the amount of methanol required for making fine inorganic particles perfectly wet.

The added amount of said external additives is between 0.1 and 5.0 percent by weight of the toner, and is preferably between 0.5 and 4.0 percent by weight. As external additives, various materials may be employed in combination.

In a suspension polymerization method in which a composition, prepared by dispersing or dissolving toner constitution components such as a colorant and the like in polymerizable monomers, is suspended in a water based medium, and then undergoes polymerization to obtain the toner, the shape of toner particles may be controlled by controlling the flow of the medium in a reaction vessel in which the reaction is carried out. Namely, when many toner particles having a shape coefficient of at least 1.2 are formed, the flow in the reaction vessel is regulated to a turbulent one; polymerization proceeds; and when oil droplets suspended in the water based medium are gradually polymerized and oil droplets become soft particles, particle union is accelerated due to collisions of particles resulting in particles which are not stable in shape. Further, when spherical toner particles having a shape coefficient of not more than 1.2 are formed, the flow of the medium in said reaction vessel is regulated to a laminar flow to result in spherical particles upon minimal collisions between particles. Employing such methods, it is possible to control the toner shape distribution within the range specified by the present invention.

Figure 8:
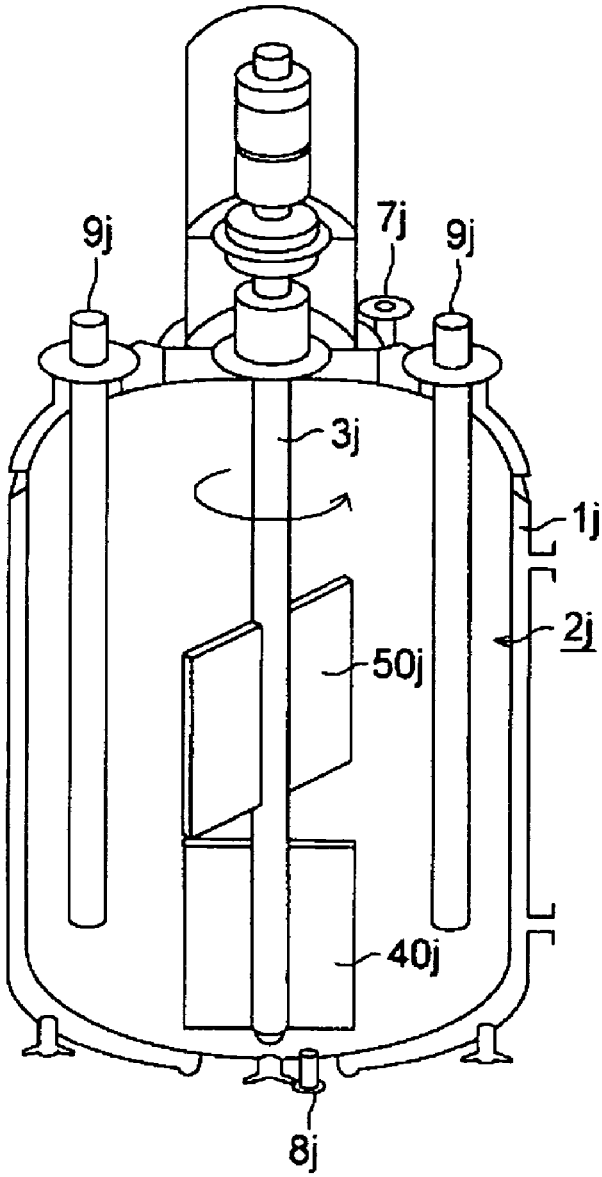
FIG. 8 is a schematic view showing an example of a reaction vessel for the toner.

A preferably employed stirring vessel, equipped with stirring blades, will be described with reference to drawings. Each FIGS. 8 and 9 is an example of a stirring vessel equipped with stirring blades. Vertical rotation shaft 3*j* is provided in the central portion in a longitudinal type cylindrical stirring vessel 2*j* equipped with jacket 1*j* for heat exchange on the circumferential portion of said stirring vessel, with integral lower level stirring blades 40*j* provided on said rotation shaft 3*j* near the bottom surface of the stirring vessel 2*j*, and stirring blades 50*j* provided at the upper level. Stirring blades 50*j* at the upper level is provided so as to have an advanced crossed axes angle $\alpha$ in the rotational direction with respect to the stirring blades 40*j* positioned at the lower level. In the present invention, the crossed axes angle α is less than 90 degrees. The lower limit of the crossed axes angle is not particularly determined, however it is commonly at least 5 degrees, and is preferably at least 10 degrees. In the case of three levels or more, the crossed axes angle α between adjacent stirring blades may be less than 90 degrees.

By such a constitution, it is assumed that a medium is first stirred by stirring blades 50*j* provided at the upper level; a flow to the lower side is then generated; subsequently, the flow rate formed by the stirring blades 50*j* at the upper level is accelerated downward by the stirring blades 40*j* provided at the lower level; at the same time, a downward flow is separately formed by the stirring blades themselves; and as a whole, the flow rate is accelerated. As a result, it is assumed that since a flow region having a large shearing stress is formed as a turbulent flow, the toner shape can be regulated.

Further, in FIGS. 8 and 9, arrows show rotational directions, reference numeral 7*j* shows an upper material deeding inlet and 8*j* shows a lower material feeding inlet. Furthermore, 9*j* is a turbulent flow forming member to make stirring more effective.

Figure 10:
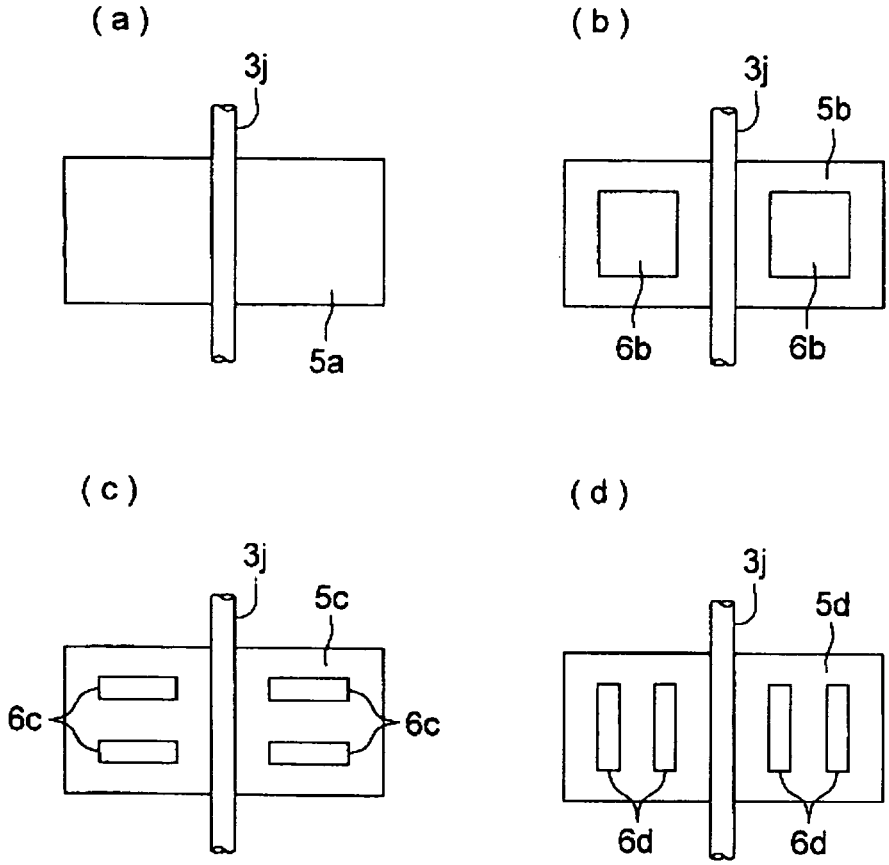
FIGS. 10(*a*) to (*d*) are each a schematic view showing an example of stirring blades.

Herein, the shape of said stirring blades is not particularly limited, however employed may be those which include a square-shaped plate blade, a blade with parts partially cut away, a blade having at least one opening, e.g. a so-called slit blade, and the like. FIG. 10 shows these examples. FIG. 10(*a*) shows a blade 5*a* having no opening, FIG. 10(*b*) shows a blade 5*b* having large opening 6*b* in the center, FIG. 10(*c*) shows a blade 5*c* having a long longitudinal opening 6*c*, and FIG. 10(*d*) shows a blade 5*d* having long lateral opening 6*d*. Blades having the same or different openings may be employed at the upper level and the lower level.

Further, the gap between the upper stirring blade and the lower one, which are arranged as described above, is not particularly limited, however a gap is preferably present between them. The reason has been not yet clear, but it is considered that the flow of a medium is formed through the gap, and accordingly, stirring efficiency is improved. However, the length of the gap is generally between 0.5 and 50 percent of the height of liquid in the standing state, and is preferably between 1 and 30 percent. Further, the size of the stirring blade is not particularly limited, however the total height of all stirring blades is between 50 and 100 percent of the height of liquid, and is preferably between 60 and 95 percent.

On the other hand, for a toner prepared by a polymerization method in which resin particles are associated or fused in an aqueous medium, it is possible to optionally vary the shape distribution as well as the shape of the particles by controlling the flow of a medium and the temperature distribution in the reaction vessel during the fusing stage, and further by controlling the heating temperature, the rotational frequency while stirring, and the time during the shape controlling process, after fusing.

Namely, regarding the toner prepared by the polymerization method in which resin particles are associated or fused, it is possible to prepare a toner, having specific shape coefficient and the uniform shape distribution described in the present invention, by controlling the temperature, the rotation frequency and the time during the fusing process and shape controlling process, employing stirring blades as well as a stirring vessel which is capable of making the flow in the reaction vessel a laminar flow and the interior temperature distribution uniform. As the reason, it is assumed that when fusing is carried out in the location in which the laminar flow is generated, particles associated or coagulated particles) while undergoing coagulation and fusing are not subjected to strong stress, and in the laminar flow in which the flow rate is accelerated, the temperature distribution in the stirring vessel is uniform, and as a result, the shape distribution of fused particles becomes uniform. Further, the fused particles are gradually varied to spherical particles by heating and stirring in the subsequent shape controlling process, and the shape of toner particles may thus be optionally controlled.

Blades and a stirring vessel, which are employed to prepare a toner employing the polymerization method in which resin particles are associated or fused, may be employed which are similar to those which are employed to generate a laminar flow in the above-mentioned suspension polymerization method. In the case, the plate to form turbulent should not be disposed in the stirring vessel.

The shape of said stirring blades may be those which is are employed to generate a laminar flow in the above-mentioned suspension polymerization method. The shape of the blades is not particularly limited, as long as it does not generate a turbulent flow, however said stirring blade is preferably constituted with a continuous surface such as a square plate shown in FIG. 10(*c*), and may alternatively have a curved surface.

Several cases may be considered for application of the toner of the present invention, in which, for example, it is employed as a single component, magnetic toner comprising magnetic materials; mixed with a so-called carrier, it is employed as a two-component toner; or a non-magnetic toner is individually employed; and the like. The toner may be suitably employed for all cases. However, mixed with the carrier, the toner is preferably employed as a two-component developer material.

<Image Forming Method and Apparatus>

Figure 5:
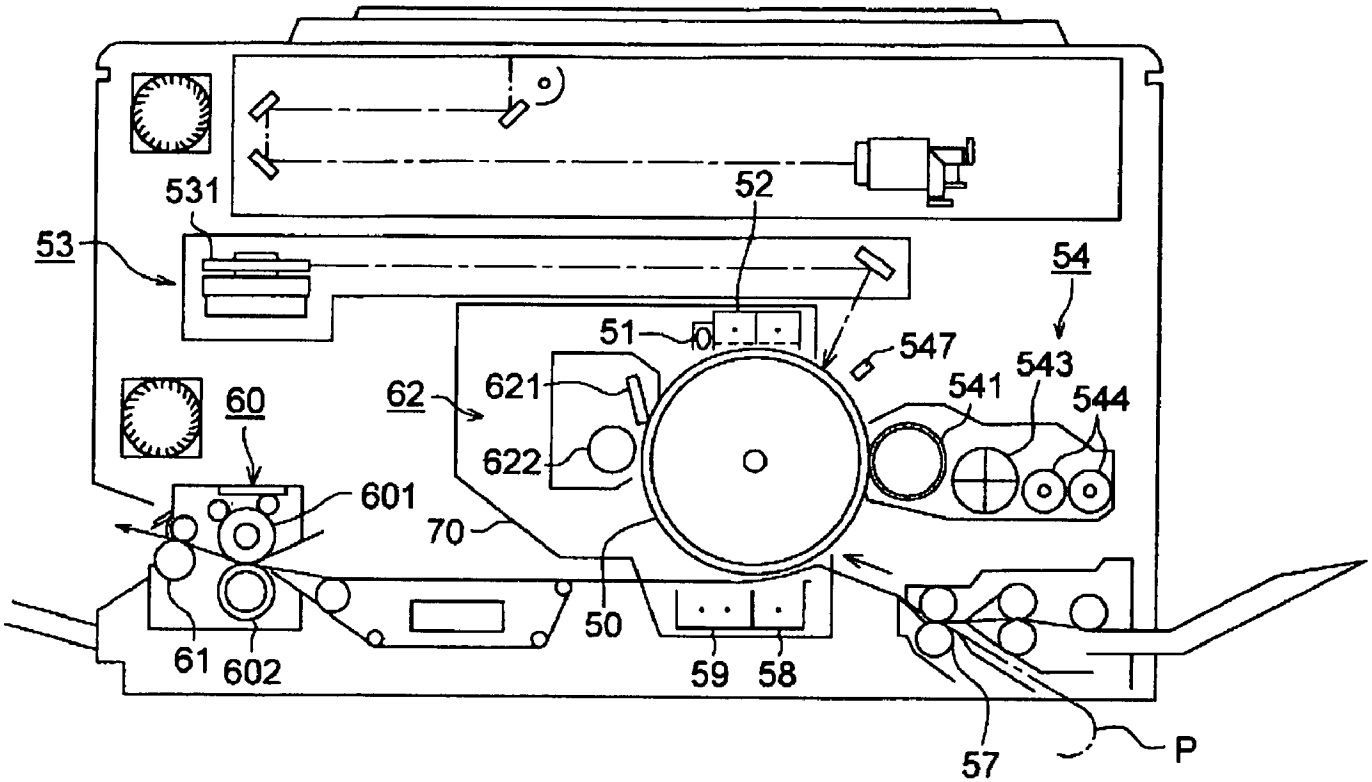
FIG. 5 is a sectional view diagrammatically illustrating an example of an image forming apparatus for carrying out the image forming method according to the invention.

FIG. 5 is a cross-sectional view of an example of an image forming apparatus for embodying the image forming method of the invention.

In FIG. 5, the reference numeral 50 denotes a photoreceptor drum (a photoreceptor) which is an image bearable body. The photoreceptor is prepared by applying an organic photosensitive layer onto the drum, and further by applying a resinous layer onto the resultant photosensitive layer. The drum is grounded and rotated clockwise. Reference numeral 52 is a scorotron charging unit (charging means) which uniformly charges the circumferential surface of photoreceptor drum 50 via corona discharge. Prior to charging, employing the charging unit 52, in order to eliminate the hysteresis of the photoreceptor due to the previous image formation, the photoreceptor surface may be subjected to charge elimination through exposure, employing a pre-charge exposure section 51 comprised of light emitting diodes.

After uniformly charging the photoreceptor, image exposure is carried out based on image signals employing an image exposing unit 53. The image exposing unit 53 comprises a laser diode (not shown) as the exposure light source. Scanning onto the photoreceptor drum is carried out employing light of which light path has been deflected by a reflection mirror 532 through a rotating polygonal mirror 531, fθ lens, and the like, and thus an electrostatic latent image is formed thereon.

The reversal developing process in this invention is an image formation method in which the surface of the photoreceptor is uniformly charged by the charging unit 52, and a portion on which image exposure is carried out, that is, an exposed portion potential of the photoreceptor (image exposed portion) is developed through a developing process (method). A non-image exposed portion is not developed since developing bias potential is applied to the photoreceptor by a developing sleeve 541.

The resultant electrostatic latent image is subsequently developed in the development unit 54. The development unit 54, which stores the developer material comprised of a carrier and a toner, is disposed adjacent to the outer peripheral surface of the photoreceptor drum 50. The development is carried out employing the development sleeve 541, internally comprises magnets and rotates while bearing the developer material on its outer peripheral surface. The interior of the developer unit 54 comprises a developer material stirring member 544, a developer material conveying member 543 and a conveying amount regulating member 542. Thus, the developer material is stirred, conveyed and supplied to the development sleeve. The supply amount is controlled by the conveying amount regulating member 542. The conveyed amount of the developer material varies depending on the linear speed of an applied organic electrophotographic photoreceptor as well as its specific gravity, but is commonly in the range of 20 to 200 mg/cm$^2$.

The developer material comprises a carrier which is prepared by coating insulation resins onto the surface of the aforementioned ferrite as the core, and a toner which is prepared by externally adding an external additive such as silica or titanium oxide, to colored particles comprised of the binder resin, a colorant such as carbon black and a charge controlling agent and which has the specific particle diameter distribution characteristics. The amount of the developer material is regulated employing the conveying amount regulating member, and then conveyed to the development zone, where the latent image developed therewith. At that time, development may be carried out while direct current bias voltage, if desired, alternative current bias voltage is applied to the space between photoreceptor drum 50 and development sleeve 541. In this case, the developer material is subjected to development in a contact or non-contact state with the photoreceptor. The potential of the photoreceptor may be carried out above the developing zone by using a potential sensor 547.

A recording paper P is supplied to the transfer zone by the rotation of paper feeding roller 57, when timing for transfer is properly adjusted.

In the transfer zone, a transfer electrode (transfer section: transferring device) 58 provided adjacent to the peripheral surface of the photoreceptor drum 50 is activated in synchronous with the transferring timing to perform the image transfer onto the recording paper P which has been introduced between the photoreceptor drum 50 and the transfer electrode 58.

Subsequently, the resultant recording paper P is subjected to charge elimination, employing separation electrode (the separation unit) 59 which has been activated almost concurrently with activation of the transfer electrode 58. Thus, the recording paper P is separated from the circumferential surface of photoreceptor drum 50, and conveyed to a fixing unit 60. Then, after the toner is fused under heat and pressure, provided by heated roller 601 as well as pressure contact roller 602, the resulting recording paper P is ejected to the exterior of the apparatus via paper ejection roller 61. Further, after passage of the recording paper P, the transfer electrode 58 and the separation electrode 59 are retracted from the circumferential surface of photoreceptor drum 50, and is prepared for the formation of subsequent toner images. In FIG. 5, a corotron electrode is used as the transfer electrode 58. The operating condition of the transfer electrode varies with the process speed (peripheral speed) of the photoreceptor drum 50 and are not specifically specified. Generally, however, the transfer current is in the range of, for example, +100 to +400 μA, and the transfer voltage is in the range of, for example, from +500 to +2,000 V.

On the other hand, the photoreceptor drum 50, from which recording paper P has been separated, is subjected to removal of any residual toner and cleaning through pressure contact with a blade 621 of a cleaning unit 62, and then subjected to charge elimination by precharge exposure section 51, as well as subjected to charging employing the charging unit 52. The photoreceptor drum 50 then enters the next image forming process.

Reference numeral 70 denotes a detachable process cartridge, which is integrally comprised of the photoreceptor, the charging unit, the transfer unit, the separation unit, and the cleaning unit.

The organic electrophotographic photoreceptor of the invention can generally be applied to electrophotographic apparatuses, laser printers, LED printers, liquid crystal shutter type printers, and the like, and can further be widely applied to apparatuses such as displays, recording media, small volume printing, plate making, facsimile production, and the like, to which common electrophotographic techniques are applied.

EXAMPLES

The following examples will further illustrate the invention. However, the embodiment of the invention is not limited to the examples.

Preparation of Cylindrical Substrate

1. Manufacture of Substrate a. Manufacturing Method of Cylindrical Substrate A-1

Figure 3:
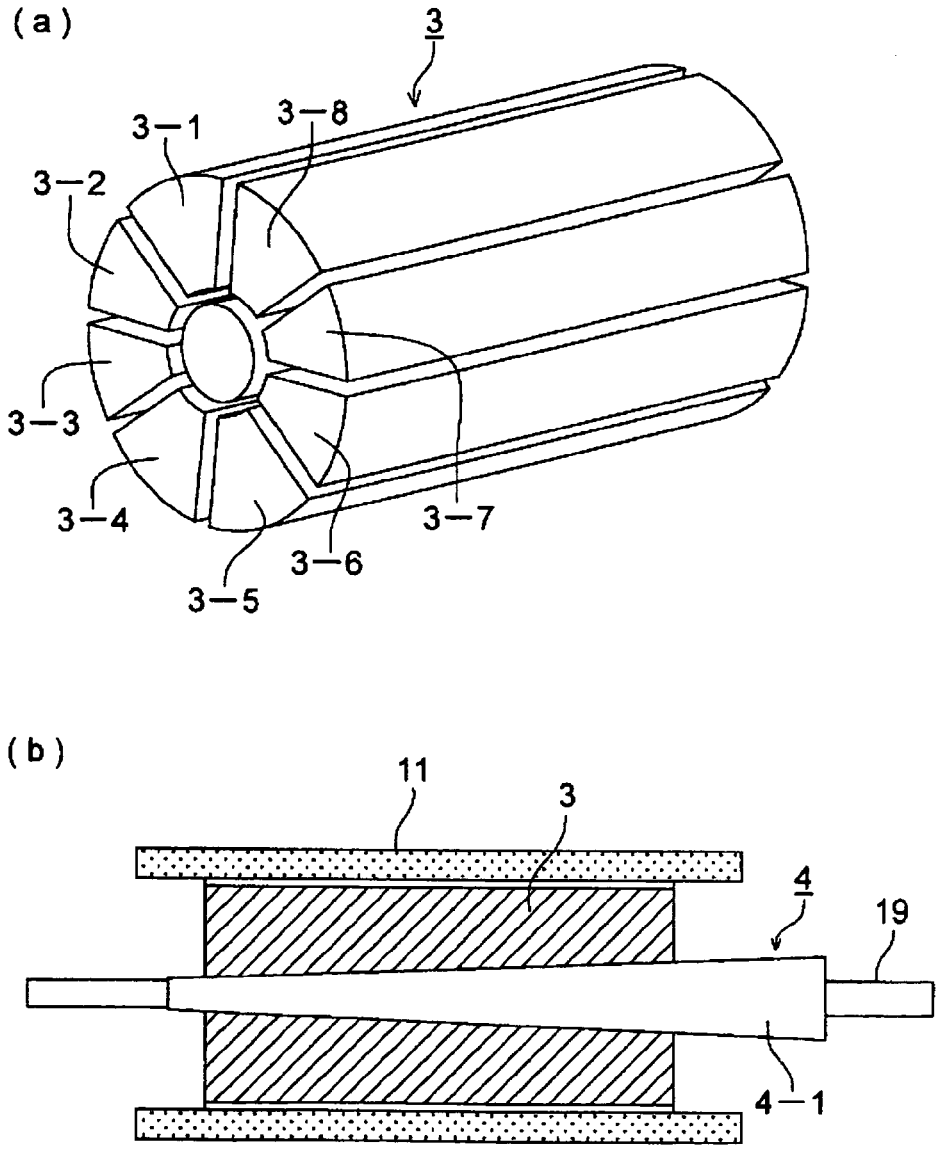
FIG. 3A is a perspective view showing one example of supporting member.
FIG. 3B is a sectional view showing one example of a pressure control device to a supporting member.

Using a contact pressure controlling section 3 shown in FIG. 3, a stainless supporting member (length D=300 mm (0.84×L)) is pressed and held against the inner periphery of a cylindrical substrate (length L=344 mm, outside diameter=100 mm) of aluminum with a thickness of 2.00 mm made by drawing process. Then, the inlay process was carried out with the outside diameter reference to have an inside diameter of 98.40 mm and a length 8 mm from the edge, using a precision CNC both-edge machining device (model BS manufactured by EGURO Inc.).

While the resulting cylinder was supported by a non-slidable chucks, the surface of the cylindrical substrate is machined by a turning process with the inside diameter reference of the inlay processed portion (the turning machine: Model SPA-5 manufactured by Shoun Kosakusho Inc.) to obtain a cylindrical substrate A-1 having a surface roughness Rz (10 points surface roughness) of 0.7 μm and a cylindricity of 8 μm.

Definition of Surface Roughness at 10 Points Rz and Measurement Method Thereof.

The surface roughness at 10 points Rz was measured in accordance with JIS B0601-1982 using a reference length of 0.25 mm. Thus, Rz is a difference between an average of the heights of the highest 5 peaks and an average of the depths of the lowest 5 valleys present in a reference length of 0.25 mm of the surface profile.

Rz was measured using a contact surface roughness tester (Surfcorder SE-30D by Kosaka Laboratory Ltd.). Any other tester capable to give same results within an error range may be employed.

b. Manufacturing Method of Cylindrical Substrate A-2

The above procedures for the manufacture of cylindrical substrate A-1 were repeated in the same manner as described except that a supporting member having a length of 214 mm (0.60×L) was used, thereby obtaining a cylindrical substrate A-2 having a 10-point surface roughness Rz of 0.7 μm and a cylindricity of 25 μm.

c. Manufacturing Method of Cylindrical Substrate A-3

The above procedures for the manufacture of cylindrical substrate A-1 were repeated in the same manner as described except that a supporting member having a length of 143 mm (0.40×L) was used, thereby obtaining a cylindrical substrate A-3 having a 10-point surface roughness Rz of 0.7 μm and a cylindricity of 35 μm.

d. Manufacturing Method of Cylindrical Substrate A-4

The above procedures for the manufacture of cylindrical substrate A-1 were repeated in the same manner as described except that a supporting member having a length of 332 mm (0.93×L) was used, thereby obtaining a cylindrical substrate A-4 having a 10-point surface roughness Rz of 0.7 μm and a cylindricity of 28 μm.

e. Manufacturing Method of Cylindrical Substrate B-1 (Gripped from Outside-Out of the Invention)

Figure 6:
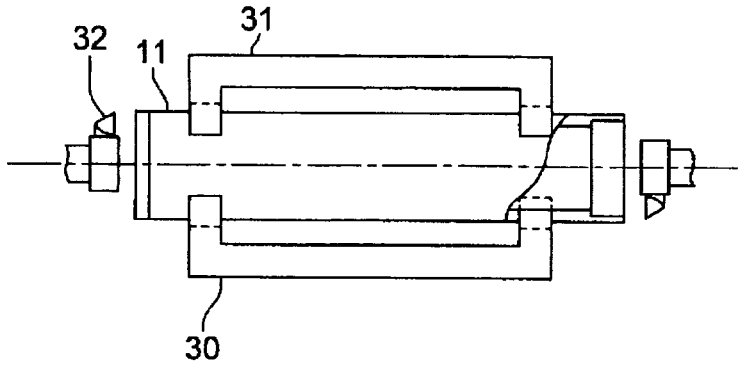
FIG. 6 shows an example of an inlay process in a substrate supported from outside.

The supporting member was not inserted into the cylindrical substrate, but was placed on a gripping member, that is, a fixing V-reception stand 30 from outside as shown in FIG. 6 (an example of the inlay process for the substrate gripped from outside), and then fixed by a pressing V-reception holder 31 on a periphery of the cylindrical substrate 11. Thereafter, the inlay process was performed by rotary drive turning bites 32 (a precision CNC both-edge machining device: model UB-600 manufactured by EGURO Inc.) on both of the right and left sides. Except that, the above procedures for the manufacture of cylindrical substrate A-1 were repeated in the same manner. The cylindrical substrate B-1 obtained has a 10-point surface roughness Rz of 0.7 μm and a cylindricity of 45 μm.

2. Manufacture of Photoreceptor:

The term "parts" represents "parts by mass".

Preparation of Photoreceptor 1

The cylindrical substrate A-3 was washed and applied with an electroconductive coating liquid having a composition shown below to form an electroconductive layer having a thickness of 15 μm (on dry basis).

| <Electroconductive Layer (PCL) Composition Liquid> | |
|---|---|
| Phenol resin | 160 parts |
| Electronductive titanium oxide | 200 parts |
| Methyl cellosolve | 100 parts |

An undercoat coating liquid having a composition shown below was applied by an immersion coating method to form an undercoat layer (UCL) having a thickness of 1.0 μm.

| <Undercoat Layer (UCL) Composition Liquid> | |
|---|---|
| Polyamide resin (Amilan CM-8000: manufactured by Toray Corp.) | 60 parts |
| Methanol | 1600 parts |
| 1-butanol | 400 parts |

A charge generation layer coating liquid was prepared by dispersing a composition shown below using a sand mill for 10 hours. The coating composition was coated by means of an immersion coating method on the above-described undercoat layer to form a charge generation layer having a thickness of 0.2 μm on dry basis.

| <Charge Generation Layer (CGL) Composition Liquid> | |
|---|---|
| Y-type titanyl phthalocyanine | 60 parts |
| Silicone resin solution (KR 5240, 15% xylene butanol solution, manufactured by Shin-Etsu Chemical Co., Ltd.) | 700 parts |
| 2-butanone | 2000 parts |

A charge transport layer coating liquid was prepared by dissolving a composition shown below. The coating composition is applied onto the above-described charge generation layer by a coating amount controlling circular coating device, as described in JP-Tokukaisyo 58-189061, to form a charge transport layer having a thickness of 20 μm, thereby obtaining a photoreceptor 1 having a cylindricity of

| <Charge Transport Layer (CTL) Composition Liquid> | |
|---|---|
| Charge transport material (N-(4-methylphenyl)-N-{4-(β-phenylstyryl)-phenyl}-p-toluidine) | 200 parts |
| Bisphenol Z type polycarbonate (Eupilon Z300 manufactured by Mitsubishi Gas Chemical Corporation) | 300 parts |
| 1,2-dichloroethane | 2000 parts |

Preparation of Photoreceptor 2

The cylindrical substrate A-4 was washed and applied with an undercoat coating liquid having a composition shown below, followed by drying at 150° C. for 30 minutes to form an undercoat layer having a thickness of 1.0 μm.

| <Undercoat Layer (UCL) Composition Liquid> | |
|---|---|
| Zirconium chelate ZC-540 manufactured by Matsumoto Seiyaku Co., Ltd.) | 200 parts |
| Silane coupling agent KBM-903 manufactured by Shin-Etsu Kagaku Co., Ltd.) | 100 parts |
| Methanol | 700 parts |
| Ethanol | 300 parts |

A charge generation layer coating liquid was prepared by dispersing a composition shown below using a sand mill for 10 hours. The coating composition is coated by means of an immersion coating method on the above-described undercoat layer to form a charge generation layer having a thickness of 0.2 μm.

| <Charge Generation Layer (CGL) Composition Liquid> | |
|---|---|
| Y-type titanyl phthalocyanine | 60 parts |
| Silicone resin solution (KR 5240, 15% xylene butanol solution, manufactured by Shin-Etsu Chemical Co., Ltd.) | 700 parts |
| 2-butanone | 2000 parts |

A charge transport layer coating liquid was prepared by dissolving a composition shown below. The coating composition is applied onto the above-described charge generation layer by a coating amount controlling circular coating device to form a charge transport layer having a thickness of 20 μm, thereby obtaining a photoreceptor 2 having a cylindricity of 29 μm.

| <Charge Transport Layer (CTL) Composition Liquid> | |
|---|---|
| Charge transport material (N-(4-methylphenyl)-N-{4-(β-phenylstyryl)-phenyl}-p-toluidine) | 200 parts |
| Bisphenol Z type polycarbonate (Eupilon Z300 manufactured by Mitsubishi Gas Chemical Corporation) | 300 parts |
| 1,2-dichloroethane | 2000 parts |

Preparation of Photoreceptor 3

An overcoat layer coating liquid was prepared by mixing and dissolving a composition shown below and applied onto the CTL of the photoreceptor 2.

<Overcoat Layer (OCL) Composition Liquid>

A polysiloxane resin (10 parts) having 80 mole % of methylsiloxane units and 20 mole % of methyl-phenylsiloxane units was mixed with 10 parts of molecular sieve 4A, and the resultant mixture was allowed to quiescently stand for 15 hours and then dehydrated. The resultant resin was dissolved in 10 parts of toluene, to which 5 parts of methyltrimethoxysilane and 0.2 part of dibutyl tin acetate were added to prepare a uniform solution. To this solution 6 parts of dihydroxymethyltriphenylamine is added to obtain an overcoat layer coating liquid. The liquid was prepared and applied by the coating amount controlling circular coating device, followed by thermal curing at 120° C. for 1 hour to form an overcoat layer with a thickness of 2 μm, thereby obtaining a photoreceptor 3 having a cylindricity of 30 μm.

Preparation of Photoreceptor 4

The cylindrical substrate A-1 obtained above was washed and applied by an immersion method with the undercoat layer coating liquid to form an undercoat layer having a thickness of 2 μm.

<Undercoat Layer (UCL) Composition Liquid>

The undercoat dispersion liquid was diluted with the same mixing solvent to two parts, then allowed to stand a night and filtrated to obtain an undercoat layer coating liquid. (Filter: manufactured by Nippon Paul Co., RIGIMESH FILTER: nominal filtration accuracy of 5 μm, $5\times10^4$ Pa)

| Undercoat Dispersion Liquid | |
|---|---|
| Polyamide resin CM8000 (produced by Toray Co. Ltd.) | 1 part |
| Titanium oxide SMT500SAS (produced by Teika Co., Ltd., subjected to surface treatment by silica, alumina and methyl hydrogen polysiloxane) | 3 parts |
| Methanol | 10 parts |

The above composition was dispersed for 10 hours using a sand mill in a batch mode to obtain an undercoat layer coating liquid.

The following composition liquids were mixed and dispersed with a sand mill to obtain a charge generation layer coating liquid. The charge generation layer coating liquid was applied by an immersion method to form a charge generation layer having a thickness of 0.3 μm on dry basis onto the above-described undercoat layer.

| <Charge Generation Layer (CGL) Composition Liquid> | |
|---|---|
| Y type oxytitanyl phthalocyanine (maximum peak angle of X-ray diffraction by character X-ray (CuKα-ray) 2θ = 27.3 degrees) | 20 parts |
| Polyvinyl butyral (#6000-C manufactured by Denki Kagaku Kogyo Co.) | 10 parts |
| t-Butyl acetate | 700 parts |
| 4-Methoxy-4-methyl-2-pentanone | 300 parts |

A charge transport layer coating liquid was prepared by mixing and dissolving a composition shown below. The coating composition was applied onto the above-described charge generation layer using a circular amount controlling type coating device to form a charge transport layer having a thickness of 24 μm, thereby obtaining a photoreceptor 4 having a cylindricity of 15 μm.

| <Charge Transport Layer (CTL) Composition Liquid> | |
|---|---|
| Charge transport material (N-(4-methylphenyl)-N-{4-(β-phenylstyryl)-phenyl}-p-toluidine) | 75 parts |
| Bisphenol Z type polycarbonate (Eupilon Z300 manufactured by Mitsubishi Gas Chemical Corporation) | 100 parts |
| Methylene chloride | 750 parts |

Preparation of Photoreceptor 5

A photoreceptor 5 was prepared in the same manner as that for photoreceptor 4, except that the cylindrical substrate A-2 was substituted for the cylindrical substrate A-1, thereby obtaining a photoreceptor 5 having a cylindricity of 26 μm.

Preparation of Photoreceptor 6 (Comparative Example 1)

A photoreceptor 6 was prepared in the same manner as that for photoreceptor 4, except that the cylindrical substrate B-1 was substituted for the cylindrical substrate A-1, thereby obtaining a photoreceptor 5 having a cylindricity of 43 μm.

Toner Production Example 1

Example of an Emulsion Polymerization Association Method

Added to 10.0 liters of pure water was 0.90 kg of sodium dodecylsulfate, which was dissolved while stirring. Slowly added to the resulting solution was 1.20 kg of Regal 330R (carbon black, manufactured by Cabot Co.), and the resulting mixture was thoroughly stirred for one hour, and thereafter, was continually dispersed for 20 hours employing a sand grinder (a medium type homogenizer). The resulting dispersion was denoted as "Colored Dispersion 1".

A solution comprised of 0.055 kg of sodium dodecylbenzenesulfonate and 4.0 liters of deionized water is denoted as "Anionic Surface Active Agent Solution A".

A solution comprised of 0.014 kg of nonylphenolpolyethylene oxide 10-mole addition product and 4.0 liters of deionized water is labeled as "Nonionic Surface Active Agent Solution B", while A solution prepared by dissolving 223.8 g of potassium persulfate in 12.0 liters of deionized water is labeled as "Initiating Solution C".

Added to 100 liters of a GL (glass lining) reaction vessel equipped with a temperature sensor, a cooling pipe, and a nitrogen gas introducing unit were 3.41 kg of WAX emulsion (polypropylene emulsion having a number average molecular weight of 3,000, and having a number average primary particle diameter of 120 nm/a solid portion concentration of 29.9 percent), all of "Anionic Surface Active Agent A", and all of "Nonionic surface Active Agent Solution B", and the resulting mixture was stirred. Subsequently, 44.0 liters of deionized water were added.

The resulting mixture was heated and when it reached 75 degree C., all of "Initiator Solution C" was added dropwise. Thereafter, while controlling the temperature at 75±1 degree C., 12.1 kg of styrene, 2.88 kg of n-butyl acrylate, 1.04 kg of methacrylic acid, and 548 g of t-dodecylmercaptan were added dropwise. After completing of dropwise addition, the resulting mixture was heated to 80± degree C., and stirred for 6 hours while maintaining said temperature. Subsequently, the mixture was cooled below 40 degree C. and stirring was terminated. Filtration was then carried out employing a pole filter and the resulting filtrate was labeled as "Latex A".

Further, the resin particles in Latex A had a glass transition temperature of 57 degree C., a softening point of 121 degree C., and regarding the molecular weight distribution, a weight average molecular weight of 12,700 and a weight average particle diameter of 120 nm.

Furthermore, a solution prepared by dissolving 0.055 kg of sodium dodecylbenezensulfonate in 4.0 liters of deionized water was designated as "Anionic Surface Active Agent solution D", while a solution prepared by dissolving 0.014 kg of nonylphenolpolyethylene oxide 10-mole addition product in 4.0 liters of deionized water was denoted as "Nonionic Surface Active Agent E".

A solution prepared by dissolving 200.7 g of potassium persulfate (manufactured by Kanto Kagaku Co.) in 12.0 liters of deionized water was labeled as "Initiator Solution F".

Added to 100 liters of a GL reaction vessel equipped with a temperature sensor, a cooling pipe, a nitrogen gas introducing unit, and a comb-shaped baffle, were 3.41 kg of WAX emulsion (polypropylene emulsion having a number average molecular weight of 3,000, having a number average primary particle diameter of 120 nm and a solid portion concentration of 29.9 percent), all of "Anionic Surface Active Agent D", and all of "Nonionic Surface Active Agent Solution E", and the resulting mixture was stirred. Subsequently, 44.0 liters of deionized water were added. The resulting mixture was heated and when heated to 70 degree C., "Initiator Solution F" was added. Thereafter, 11.1 kg of styrene, 4.00 kg of n-butyl acrylate, 1.04 kg of methacrylic acid, and 9.02 g of t-dodecylmercaptan were previously mixed and added dropwise. After completing of dropwise addition, the resulting mixture was controlled to 72±2 degree C., and stirred for 6 hours. Further, after being heated to 72±2 degree C., stirring was continued for 12 hours while maintaining said temperature. Subsequently, the temperature was lowered below 40 degree C. and stirring was terminated. Filtration was then carried out employing a pole filter and the resulting filtrate was labeled as "Latex B".

Further, it was found that the resin particles in Latex B had a glass transition temperature of 58 degree C., a softening point of 132 degree C., and regarding the molecular weight distribution, a weight average molecular weight of 245,000 and a weight average particle diameter of 110 nm.

A solution prepared by dissolving 5.36 kg of sodium chloride in 20.0 liters of deionized water was labeled as "Sodium Chloride Solution G".

A solution prepared by dissolving 1.00 g of a fluorine based nonionic surface active agent in 1 l of deionized water was labeled as "Nonionic Surface Active Agent Solution H".

Added to a stainless steel reaction vessel (with constitution of the stirrer blades having the angle of the blade of 25 degree as shown in FIG. 8) equipped with a temperature sensor, a cooling pipe, a nitrogen gas introducing unit, a monitoring unit for the particle diameter and shape, were 20.0 kg of Latex A, 5.2 kg of Latex B, and 0.4 kg of dispersion of colorant, which were prepared as described above, and 20.0 kg of deionized water, and the resulting mixture was stirred. Subsequently the mixture was heated to 40 degree C., and Sodium Chloride Solution G, 6.00 kg of isopropanol (manufactured by Kanto Kagaku Co.), and Nonionic Surface Active Agent Solution H were added in that order. Thereafter, after the resulting mixture was left for 10 minutes, it was heated to 85 degree C. over 60 minutes. While maintaining the temperature at 85±2 degree C. while stirring, salting out/fusion were carried out to increase the particle diameter. Next, 2.1 liters of deionized water were added to terminate the growth of the particle diameter to form fused particle dispersion.

Added to reaction vessel 5 liters (with constitution of the stirrer blades having the angle of the blade of 20 degree as shown as shown in FIG. 8) equipped with a temperature sensor, a cooling pipe, and a monitoring unit for the particle diameter and shape were 5.0 kg of fused particle dispersion prepared as described above, and at 85±2 degree C., the dispersion was stirred for 0.5 to 15 hours to control the particle shape. Thereafter, the resulting dispersion was cooled below 40 degree C., and stirring was stopped. Subsequently, employing a centrifuge, classification was carried out of the liquid employing a centrifugal sedimentation method. The resulting liquid was filtered employing a sieve having a sieve opening of 45 μm, and the filtrate was labeled as Association Liquid 1. Subsequently, employing a glass filter, non-spherical particles in a wet cake were collected from Association Liquid 1 employing filtration. Thereafter, those particles were washed with deionized water.

The resulting non-spherical particles were dried at an intake air temperature of 60 degree C. employing a flash jet dryer, and were then dried at 60 degree C. employing a fluid layer dryer. Externally mixed with 100 weight parts of the prepared colored particles was one weight part of fine silica particles employing a Henschel mixer to obtain the toner employing the emulsion polymerization method.

Toners 1 through 17 were prepared in such a manner that during the above-mentioned salting out/fusion stage and monitoring of the shape controlling process, by controlling the stirrer rotation frequency as well as the heating time, the shape as well as the variation coefficient of the shape coefficient was controlled, and further, employing classification in the liquid, the particle diameter as well as the variation coefficient of the particle size distribution was optionally regulated. The properties of toners 1 to 17 are shown in Table 1.

TABLE 1

| A | B | C | D | E | F | $M(m_1 + m_2)$ (%) |
|---|---|---|---|---|---|---|
| 1 | 68.3 | 15.2 | 88 | 5.6 | 25.9 | 80.7 |
| 2 | 73.2 | 12.2 | 94 | 5.7 | 20.7 | 82.3 |
| 3 | 65.1 | 14.8 | 52 | 5.4 | 26.6 | 71.4 |
| 4 | 63.4 | 15.7 | 51 | 5.3 | 26.1 | 70.5 |
| 5 | 67.7 | 16.8 | 53 | 5.6 | 26.5 | 72.4 |
| 6 | 68.2 | 16.9 | 88 | 5.7 | 22.0 | 79.8 |
| 7 | 67.7 | 15.2 | 46 | 5.6 | 25.9 | 80.7 |
| 8 | 74.1 | 12.4 | 89 | 5.7 | 27.8 | 71.6 |
| 9 | 65.1 | 15.0 | 51 | 5.6 | 25.6 | 67.4 |
| 10 | 60.2 | 17.2 | 53 | 5.7 | 25.8 | 70.5 |
| 11 | 66.1 | 16.9 | 42 | 5.7 | 22.0 | 79.8 |
| 12 | 65.1 | 17.7 | 55 | 5.5 | 26.7 | 71.0 |
| 13 | 67.7 | 16.8 | 53 | 5.6 | 26.2 | 68.2 |
| 14 | 62.1 | 15.1 | 40 | 7.7 | 26.0 | 68.2 |
| 15 | 62.5 | 17.2 | 53 | 8.2 | 25.8 | 67.8 |
| 16 | 60.5 | 17.8 | 42 | 5.7 | 26.2 | 68.3 |
| 17 | 61.5 | 18.0 | 44 | 8.8 | 28.4 | 65.3 |

In Table 1, A represents toner number, B represents a variation coefficient of shape coefficient (%), C represents ratio of toner particles in number having no corner, D represents number average particle diameter of the toner particles (μm), F represents a number variation coefficient in the number particle size distribution.

[Preparing of Developer]

Developers 1 to 17 for the evaluation were prepared by mixing each of 10 parts of the toners 1 to 17 with 100 parts of ferrite carriers coated with styrene-methacrylate copolymer having average diameters of 45 μm.

Evaluation

The Photoreceptors 1 through 6 and Developers 1 through 17 were combined as shown in Table 2. Each of the combinations was evaluated employing a digital copier Konica "Sitios 7075" manufactured by Konica Corp. as a copier for evaluation. The copier was adapted to perform a process including corona charging, laser exposure, reversal development, electrostatic transfer, claw separation blade cleaning and cleaning utilizing a supplementary brush roller and operated at a printing rate of 75 sheets/minute. Cleaning properties and images were evaluated by copying an original document having four equal quarter parts of a text having a pixel ratio of 7 percent, a portrait, a solid white image, and a solid black image, employing A4 neutral paper sheets. The original document was continuously copied employing 200,000 sheets at high temperature and high humidity (30° C. and 80 percent relative humidity) which were assumed to be the severest conditions, and the resulting halftone, solid white images and solid black images were evaluated. Incidentally, prior to initial printing, the photoreceptor was fitted with the cleaning blade by dusting the photoreceptor surface with setting powder. Thereafter, 200,000 copies were produced. Evaluation items as well as evaluation criteria are shown below.

TABLE 2

| No. | G | H | I |
|---|---|---|---|
| 1 | 4 | 15 | 1 (1) |
| 2 | 4 | 15 | 2 (2) |
| 3 | 4 | 15 | 3 (3) |
| 4 | 4 | 15 | 4 (4) |
| 5 | 4 | 15 | 5 (5) |
| 6 | 4 | 15 | 6 (6) |
| 7 | 4 | 15 | 7 (7) |
| 8 | 4 | 15 | 8 (8) |
| 9 | 4 | 15 | 9 (9) |
| 10 | 4 | 15 | 10 (10) |
| 11 | 4 | 15 | 11 (11) |
| 12 | 4 | 15 | 12 (12) |
| 13 | 4 | 15 | 13 (13) |
| 14 | 4 | 15 | 14 (14) |
| 15 | 4 | 15 | 15 (15) |
| 16 | 4 | 15 | 16 (16) |
| 17 | 4 | 15 | 17 (17) |
| 18 | 1 | 35 | 2 (2) |
| 19 | 2 | 29 | 2 (2) |
| 20 | 3 | 30 | 2 (2) |
| 21 | 5 | 26 | 2 (2) |
| 22 | 6 | 43 | 2 (2) |

In Table 2, G represents number of photoreceptor, H represents cylindricity of the photoreceptor (μm), and I represents number of developer.

A: 1.2 or more in both initial and 200,000th copies (excellent)

B: 1.0 or more but less than 1.2 in both initial and 200,000th copies (acceptable in practical use)

C: less than 1.0 in at least one of initial and 200,000th copies (unacceptable in practical use):

Fog: Evaluated by a Solid White Image Density

A density of copy paper without having been printed (blank paper) was measured at 20 points for absolute image density using Macbeth reflection densitometer "RD-918" and the average value of the 20 measured values was calculated as a blank density. Next, a white image was copied on a copy paper and the copy was measured at 20 points for absolute image density in the same manner as above (initial copy and 200,000th copy). The difference between the sample density and the blank density was calculated from which the fog was evaluated based on the following ratings.

A: 0.005 or less in both initial and 200,000th copies (excellent)

B: 0.01 or less but greater than 0.005 in both initial and 200,000th copies (acceptable in practical use)

C: greater than 0.01 (unacceptable in practical use)

Resolution: (Evaluated Based on Legibility of Character Images)

A: No difference in resolution is seen between the image of the initial copy and the image of the 200,000th copy B: Sight deterioration in resolution is seen after the 200,000th copy of half tone image C: Significant deterioration in resolution is seen after 200,000th copy of half tone image Halftone Image Unevenness:

Unevenness of a halftone image was evaluated by measuring a density difference (ΔHD=maximum density−minimum density) of a halftone image (an uniform image having a density of around 0.2) of the 200,000th copy. A density of copy paper without having been printed (blank paper) was measured at 20 points for absolute image density by use of Macbeth reflection densitometer "RD-918" and let the average value be a blank paper density. Next, measurement was carried out in a similar manner at 20 points to determine an absolute image density.

A: ΔHD is 0.05 or less (excellent)

B: ΔHD is greater than 0.05 but less than 0.1 (acceptable in practical use)

C: ΔHD is 0.1 or more (unacceptable in practical use)

Toner Transferability:

Toner removed by the cleaning unit was collected in a bag without being recycled to the developing unit. The toner transferability was calculated according to the following formula:

$$\text{Toner transferability (\%)}=\{1-(\text{amount of toner collected})/(\text{amount of toner consumed})\}\times 100$$

Cleaning Efficiency:

After 100,000 copies had been produced, 10 copies were continuously produced using A3 copy papers. Whether or not cleaning failure occurred was determined by observing the background portions of the 10 copies. Similar measurement was carried out after the production of 200,000 copies.

Cleaning Efficiency Was Evaluated According to the Following Ratings:

A: No cleaning failure (passage of toner particles through the cleaning unit without being removed) was observed even after 200,000 copies B: No cleaning failure (passage of toner particles through the cleaning unit without being removed) was observed after 100,000 copies C: Cleaning failure occurred before 100,000 copies Other Evaluation Conditions:

In the above measurements, the other evaluation conditions using the copier "Sitios 7075" were set as follows.

Charging Condition:

Charging device was a scorotron charger. Initial charge potential was at −750 V.

Exposure Condition:

Exposure amount was set to provide a potential of the exposed area of −50 V.

Development Condition:

DC bias voltage was set at −550 V. The developer used is for toners comprising a carrier having a ferrite core surrounded by a silicone coating, a colorant such as carbon black or the like with styrene-acryl based resins as a main material, a charge control agent, a colorant particle comprised of a low-molecular polyolefin, which is externally added with titanium, alumina or the like.

Transfer Condition:

Corona charging method was used.

Cleaning Condition:

A cleaning blade having a hardness of 70, an impact resiliency of 65%, a thickness of 2 mm and a free length of 9 mm was disposed in a counter direction in pressure contact with the photoreceptor at a linear pressure of 18 N/m using a weight.

The results of evaluation are showing Table 3.

TABLE 3

| No. | Image density | Fog | Resolution | Cleaning property | Unevenness of the half tone | Toner transfer ratio (%) | Note |
|---|---|---|---|---|---|---|---|
| 1 | A | A | A | A | A | 92 | Invention |
| 2 | A | A | A | A | A | 94 | Invention |
| 3 | A | A | A | A | A | 91 | Invention |
| 4 | A | A | B | B | A | 91 | Invention |
| 5 | A | A | B | B | A | 88 | Invention |
| 6 | A | A | B | B | A | 88 | Invention |
| 7 | A | A | B | A | B | 87 | Invention |
| 8 | B | A | B | B | A | 84 | Invention |
| 9 | B | A | B | B | A | 85 | Invention |
| 10 | B | A | B | B | A | 83 | Invention |
| 11 | B | A | B | B | B | 82 | Invention |
| 12 | B | A | B | B | A | 82 | Invention |
| 13 | B | A | B | B | A | 81 | Invention |
| 14 | B | A | B | B | B | 81 | Invention |
| 15 | B | A | B | B | B | 81 | Invention |
| 16 | B | A | B | B | B | 80 | Invention |
| 17 | B | A | C | C | C | 74 | Comp. |
| 18 | B | A | B | B | B | 85 | Invention |
| 19 | A | A | A | A | A | 92 | Invention |
| 20 | A | A | A | A | A | 89 | Invention |
| 21 | A | A | A | A | A | 92 | Invention |
| 22 | B | A | B | C | C | 78 | Comp. |

As is evident from Table 3, combination Nos. 1–16 and 18–21 in which a cylindrical photoreceptor having a cylindricity of 5 to 40 μm is used in conjunction with a toner sufficing at least one of the following conditions (1) to (5) exhibit superior image density, resolution, cleaning efficiency, halftone evenness and toner transferability as compared with combination Nos. 17 and 22 which do not meet with the these conditions. Especially Nos. 1 to 3 and 18 to 21 that sufficing all the conditions (1) to (5) exhibit excellent results.

(1) toner includes toner particles having a variation coefficient of shape coefficient of not more than 16 percent.

(2) A toner includes at least 65 percent of toner particles having a shape coefficient in the range of 1.2 to 1.6.

(3) A toner includes at least 50% of toner particles in number having no corner.

(4) A toner includes toner particles having a number variation coefficient in the number particle size distribution of not more than 27 percent.

(5) A toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

As is apparent from the examples described above, in the image forming method meeting the conditions the above, can attain good cleaning efficiency and can afford sharp images having good image evenness.

The entire disclosure of JP-Tokukai-2001-390862 which was filed on Dec. 25, 2001, including specification, claims, drawings and summary are incorporated herein by reference in its entirety.

What is claimed is:

1. An image forming method comprising:

developing a latent image formed on a cylindrical electrophotographic photoreceptor having a cylindricity of 5 to 40 μm, with a developer comprising a toner having a variation coefficient of shape coefficient of not more than 16 percent.

2. The method of claim 1, wherein the toner comprises resin particles obtained by agglomerating in an aqueous medium.

3. The method of claim 1, wherein the toner comprises colored particles obtained by salting-out/fusing at least resin particles in an aqueous medium.

4. The method of claim 1, wherein the cylindricity is 7 to 30.

5. The method of claim 1, wherein the toner includes at least 65 percent of toner particles having a shape coefficient in the range of 1.2 to 1.6.

6. The method of claim 1, wherein the toner includes at least 50% of toner particles in number having no corner.

7. The method of claim 6, wherein toner has a number variation coefficient in the number particle size distribution of not more than 27 percent.

8. The method of claim 7, the toner comprises colored particles obtained by salting-out/fusing at least resin particles in an aqueous medium.

9. The method of claim 7, wherein the cylindricity is 7 to 30.

10. The method of claim 7, the toner includes at least 65 percent of toner particles having a shape coefficient in the range of 1.2 to 1.6

11. The method of claim 7, wherein the toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in 1 μm) represents the particle diameter of a toner particle, while being divided into a plurality of classes at intervals of 0.23, and number of particles is used as an ordinate.

12. The method of claim 11, wherein the toner includes at least 65 percent of toner particles having a shape coefficient in the range of 1.2 to 1.6.

13. The method of claim 1, wherein the toner has a number variation coefficient in the number particle size distribution of not more than 27 percent.

14. The method of claim 6, wherein the toner includes at least 65 percent of toner particles having a shape coefficient in the range of 1.2 to 1.6.

15. The method of claim 13, wherein the toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

16. The method of claim 15, the toner includes at least 65 percent of toner particles having a shape coefficient in the range of 1.2 to 1.6.

17. The method of claim 1, wherein the toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

18. The method of claim 17, wherein the toner includes at least 65 percent of toner particles having a shape coefficient in the range of 1.2 to 1.6.

19. The method of claim 1, wherein the toner has a number average particle diameter of 3 to 8 μm.

20. An image forming method, comprising: developing a latent image formed on a cylindrical electrophotographic photoreceptor having a cylindricity of 5 to 40 μm, with a developer comprising a toner including at least 65 percent of toner particles having a shape coefficient in the range of 1.2 to 1.6.

21. The method of claim 20, wherein the cylindricity is 7 to 30.

22. The method of claim 20, wherein the toner includes at least 50% of toner particles in number having no corner.

23. The method of claim 22, wherein toner has a number variation coefficient in the number particle size distribution of not more than 27 percent.

24. The method of claim 23, wherein the toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

25. The method of claim 22, wherein the toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

26. The method of claim 20, wherein the toner has a number variation coefficient in the number particle size distribution of not more than 27 percent.

27. The method of claim 26, wherein the toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

28. The method of claim 20, wherein the toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

29. An image forming method comprising: developing a latent image formed on a cylindrical electrophotographic photoreceptor having a cylindricity of 5 to 40 μm, with a developer comprising a toner having M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

30. The method of claim 29, wherein the toner includes at least 50% of toner particles in number having no corner.

31. The method of claim 30, wherein toner has a number variation coefficient in the number particle size distribution of not more than 27 percent.

32. The method of claim 29, wherein toner has a number variation coefficient in the number particle size distribution of not more than 27 percent.

33. An image forming method comprising: developing a latent image formed on a cylindrical electrophotographic photoreceptor having a cylindricity of 5 to 40 μm, with a developer comprising a toner having a number variation coefficient in the number particle size distribution of not more than 27 percent.

34. The method of claim 33, wherein the toner comprises resin particles obtained by agglomerating in an aqueous medium.

35. The method of claim 33, wherein the toner comprises colored particles obtained by salting-out/fusing at least resin particles in an aqueous medium.

36. The method of claim 33, wherein the cylindricity is 7 to 30.

37. The method of claim 33, wherein the photoreceptor is obtained by a method comprising:

inserting a supporting member into a cylindrical substrate to press the supporting member against an inner peripheral surface of the cylindrical substrate;

performing an inlay process with an outside diameter reference to the cylindrical substrate which is held from inside;

holding both sides of the cylindrical substrate by a holding member;

performing a cutting process on an outer periphery surface of the cylindrical substrate with an inside diameter reference of a portion on which the inlay process was performed.

38. The method of claim 33, comprising:

transferring a toner image formed through development onto a recording medium; and removing a residual toner on the photoreceptor after the transferring.

* * * * *